United States Patent [19]

Salah

[11] Patent Number: 4,479,722

[45] Date of Patent: Oct. 30, 1984

[54] ELECTRONIC DIGITAL DISPLAY WATCH HAVING SOLAR AND GEOGRAPHICAL FUNCTIONS

[76] Inventor: Ibrahim M. Salah, Salzhausstrzusse 7, 2503 Biel, Switzerland

[21] Appl. No.: 274,264

[22] Filed: Jun. 16, 1981

Related U.S. Application Data

[63] Continuation of Ser. No. 271,859, Jun. 9, 1981, abandoned.

[30] Foreign Application Priority Data

Jun. 10, 1980 [CH] Switzerland ..... 4453/80

[51] Int. Cl.[3] ..... G04B 19/26

[52] U.S. Cl. ..... 368/17; 368/22; 368/29

[58] Field of Search ..... 368/10, 15–18, 368/21–24, 82, 239; 364/705, 709, 710

[56] References Cited

U.S. PATENT DOCUMENTS 4,253,169 2/1981 Salah ..... 368/15
4,316,272 2/1982 Maito ..... 368/21
4,354,260 10/1982 Planzo ..... 368/10

*Primary Examiner*—Vit W. Miska
*Attorney, Agent, or Firm*—Allegretti, Newitt, Witcoff & McAndrews, Ltd.

[57] ABSTRACT

In order to provide easily accessible knowledge of the correlations between time, the geographical locale and the solar positions, the watch in question in addition to time-keeping means capable of displaying the current time (8.46A) also provides means capable of storing, processing in a microprocessor mode and displaying in a particular panel mode data of solar elevation and azimuth (h 35.4) as well as date data (11 27), a computer performing correlating operations between these various values. Pushbuttons (BPH′, BPM′, BPB′) allow using this watch in various operational and correction situations, and other pushbuttons (BPH, BPM, BPB) allow more specific commands for correction, for search operations regarding date and place based on the solar data, for storage and call from memory of the various processed data.

This watch can easily be implemented as a small wrist watch. It will be advantageously used by those interested in knowing the solar positions, by solar facility engineers, architects, airline pilots, believers in the Moslem faith etc.

23 Claims, 13 Drawing Figures

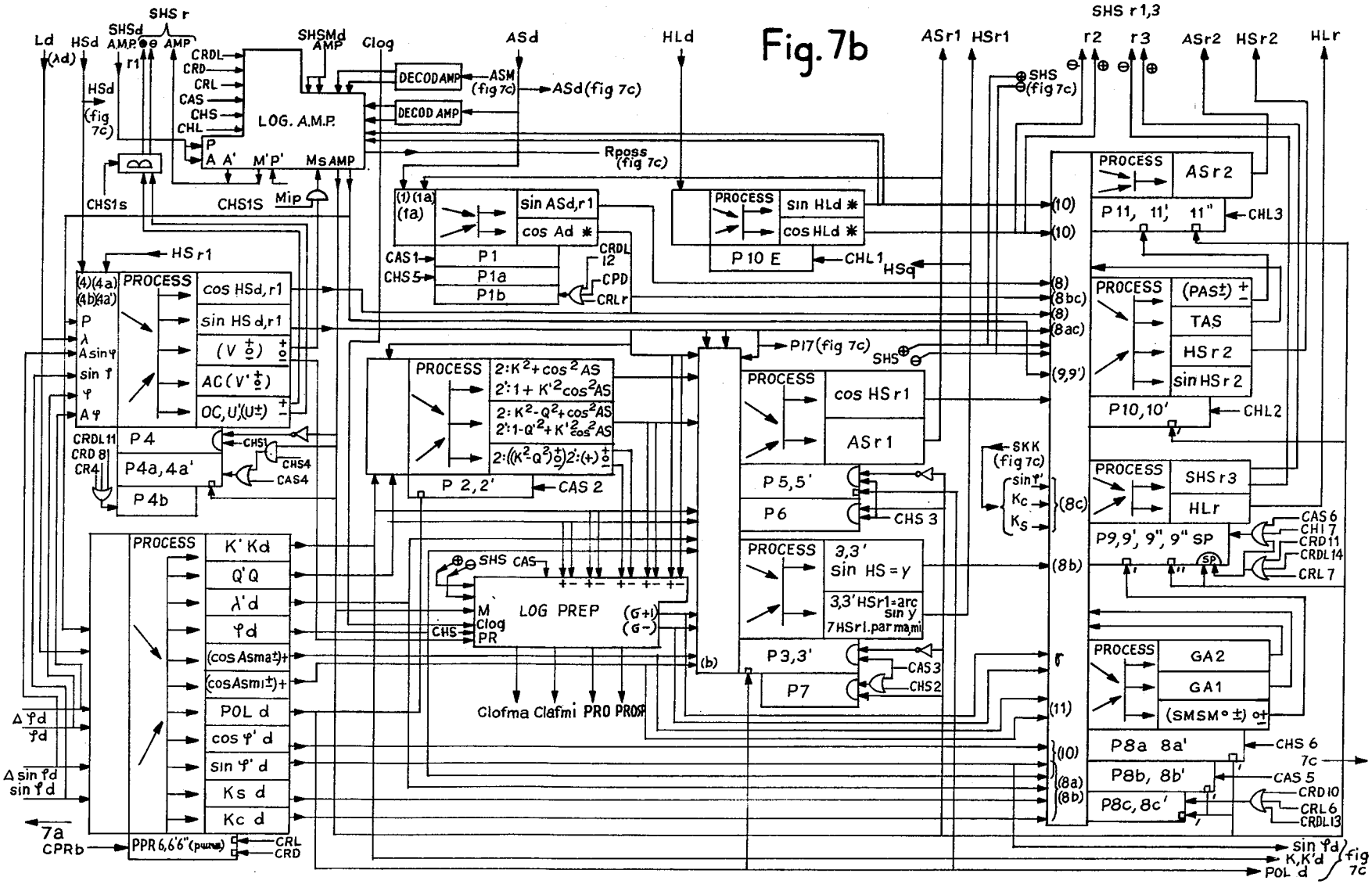
PROCESS
P 11, 11', 11''
ASr2
CHL3
P10, 10'
TAS
HSr2
sin HSr2
CHL2
P9, 9', 9'' SP
SHSr3
HLr
CAS6
CHL7
CRD11
CRDL14
CRL7
P8a 8a'
P8b, 8b'
P8c, 8c'
GA2
GA1
CHS6
CAS5
CRD10
CRL6
CRDL13
P 10 E
sin HLd *
cos HLd *
CHL1
HSq
P17 (fig 7c)
P 5, 5'
P6
cos HSr1
ASr1
CHS3
P 3, 3'
P7
sin HS = y
CAS3
CHS2
P1
P1a
P1b
sin ASd, r1
cos Ad *
CAS1
CHS5
CRDL 12
CPD
CRLr
P 2, 2'
CAS 2
LOG PREP
Clofma Clafmi PRO PROR
DECOD AMP
LOG. A.M.P.
MsAMP
Mip
CHS1S
CHS1s
cos HSd, r1
sin HSd, r1
AC (V')
OC, U'(U±)
P4
P4a, 4a'
P4b
CHS4
CAS4
K' Kd
Q'Q
λ'd
φd
POL d
cos φ' d
sin φ' d
Ks d
Kc d
PPR 6,6'' (pmm)
CRL
CRD
SHS r1,3
r2
r3
HLr
HSr2
ASr2
HSr1
ASr1
HLd
ASd
Ld
HSd
SHSr
SHSd
Glog
SHSMd
AMP
CRDL
CRD
CRL
CAS
CHS
CHL
ASd (fig 7c)
ASM (fig 7c)
Rposs (fig 7c)
SHS (fig 7c)
SKK (fig 7c)
Fig. 7b

ELECTRONIC DIGITAL DISPLAY WATCH HAVING SOLAR AND GEOGRAPHICAL FUNCTIONS

This is a continuation application of patent application Ser. No. 271,859, filed June 9, 1981, now abandoned.

BACKGROUND OF THE INVENTION

The present invention relates to an electronic, digital display watch, and more particularly relates to a wrist-watch having solar and geographical functions. The watch includes timekeeping means for the current date and time.

Heretofore watches have been proposed which provide to time and date data. The more advanced watches count the months and years of a four-year cycle. Various watches in addition to time and date provide information relating to the sun's trajectory, for example the time of sunrise and sunset. However, such watches are restricted in that solar information is related to the time of the locality which rarely coincides with the official time which is the time at the center of the time zone being considered or at the center of an easterly time zone (summer time, double summer time). Moreover, proposed watches have provided proper solar data only for certain geographic latitude zones, or for a certain number of selected geographic latitude zones.

Also known are digital electronic wrist-watches with computing functions. Such watches amount to small pocket computers. A major drawback of such watches is the difficulty in providing a relatively large number of push-buttons needed for a pocket computer on the relatively small area of the wrist-watch. Thus several tens of required push-buttons are arrayed on the major part of the watch face. The buttons are forced to be made very small, to the extent that the buttons cannot be finger actuated but demand the use of a sharp point similar to the tip of a ball-point pen. Still these computer-watches only amount to a pocket computer of low sophistication, permitting the four basic operations and several similar functions. Such watches do not allow complex programming with different sequential operations, requiring storage of a complex program.

Presently there is an increased interest by persons in ability to gather solar position information under different circumstances. Such persons include the increasing number of persons engaged in installing solar energy receiving means; architects and urban planners dealing with shade and shade direction; and pilots and airplane passengers involved in long distance flights wishing to know when night, day, sunset etc., shall take place. Another category of persons wishing to know solar position parameters, are the faithful of the Moslem religion for whom prayer hours are determined by the path of the sun. For example, the time of interrupting the Ramadan fast—which is defined as the time of complete night fall—can be physically defined as the time when the sun has dropped about 12° below the horizon. The moment this takes place varies with latitude and the period of the solar year. The Ramadan shifts progressively from summer to winter and vice versa in a cycle of about 30 years.

In view of the above, it is clear that particularly interesting computing functions for integration into a watch are those relating to the sun. On the other hand, existing computer watches are designed for general use, not particularly for solar computation operations nor can they store the very complex programs.

The prior state of the art therefore suffers from gaps regarding a computing watch of the particular type discussed above, and which, in spite of its specialized functions, should permit operation by means of a small number of push buttons which are easily actuated with fingers without cluttering the watch face, and under these conditions making possible permanent or semi-permanent storage of complex computing programs, again in view of the above cited specialization. Note should be taken also that as regards existing computer watches, most of the watch face is taken up by push-buttons so that the display area is small, whereby only a few digits can be displayed or else the display characters must be quite tiny. This drawback should be eliminated in the above considered special watch.

SUMMARY OF THE INVENTION

It is an object of the present invention to create such an electronic digital display watch having solar functions and meeting the needs and interests described above and eliminating the drawbacks, also aforementioned, of the computer wrist watches with a general function as they are known in the prior art.

This object is achieved by the invention defined in the attached claims.

The claims define particularly advantageous modes of embodiments regarding mainly the convenience of actuating the solar computer watch and the convenience in reading the data provided, and again with respect to the grouping of the functions and the function commands, it being understood that from the very large number of functions made possible by the watch, each user will be easily able to retain a particular group of functions of particular interest to him without having to necessarily remember the complete operational instructions for the watch relating to all the other functions he is less interested in. The advantageous implementation modes defined by the claims therefore specify on one hand a large number of functions to be advantageously included in a watch to make it quite universal and on the other hand a rational arrangement of these functions to allow the user—in the light of the above explanations—a selective learning of the manipulations necessary to those functions especially useful to him.

BRIEF DESCRIPTION OF THE DRAWINGS

The attached drawings illustratively show one embodiment mode offering numerous possible variations in the invention.

FIG. 2 is not comprehensive.

FIG. 6 also shows the display control and the multiplex display of the main data.

FIGS. 7*a*, 7*b* and 7*c* diagrammatically show the watch part which is the computer and implemented in the form of a microprocessor, the components shown in FIG. 5 mainly symbolizing elementary microprocessor programs, i.e. the material components by which the microprocessor carries out these programs, where these elements in large part are the same for most of the programs, and not shown as such.

DESCRIPTION OF THE PREFERRED EMBODIMENT

First the appearance of the watch and its functions as seen solely by the user will be considered.

As a rule, the watch is likely to be in one of three modes, namely a normal RN mode, an I RTI screen mode and an II RTII panel mode. A set including the two modes RTI and RTII is called the panels mode RT. In addition, the watch may be in four situations regarding the data it displays, namely a situation of no correction SCN, a situation of forward correction SCAV, a situation of backward correction SCAR and a situation of panel operations STT.

Figure 1:
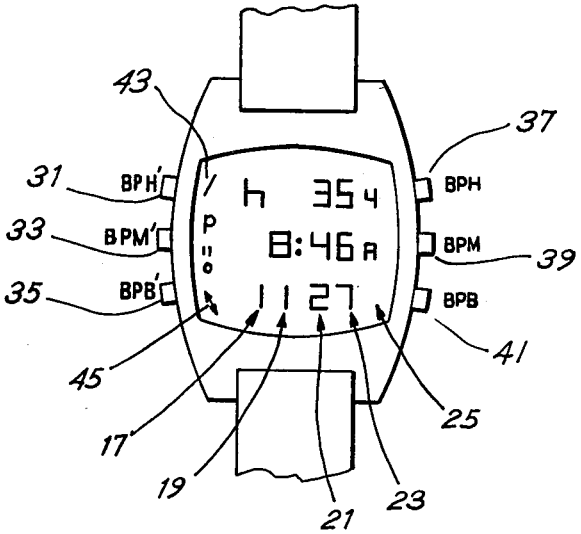
FIG. 1 is a front view of an electronic wrist watch with a digital display of solar and geographical functions of the concept being discussed and showing the watch in one of its states.

In FIG. 1, the watch is shown in the panel I RTI mode and in the panel operations situation. The 18 examples of FIG. 2, C11–C16, C21–C26, C31–C36 (where the figures including the letter 'C' indicate the coordinate positions of each example in FIG. 2) first show three watch examples in the normal watch mode RN (C11, C12, C13), then eleven examples of the watch in the I RTI panel mode (C14–C16, C21–C26, C31–C32) and lastly four examples of the watch in the II RTII panel mode (C33–C36).

Figure 2:
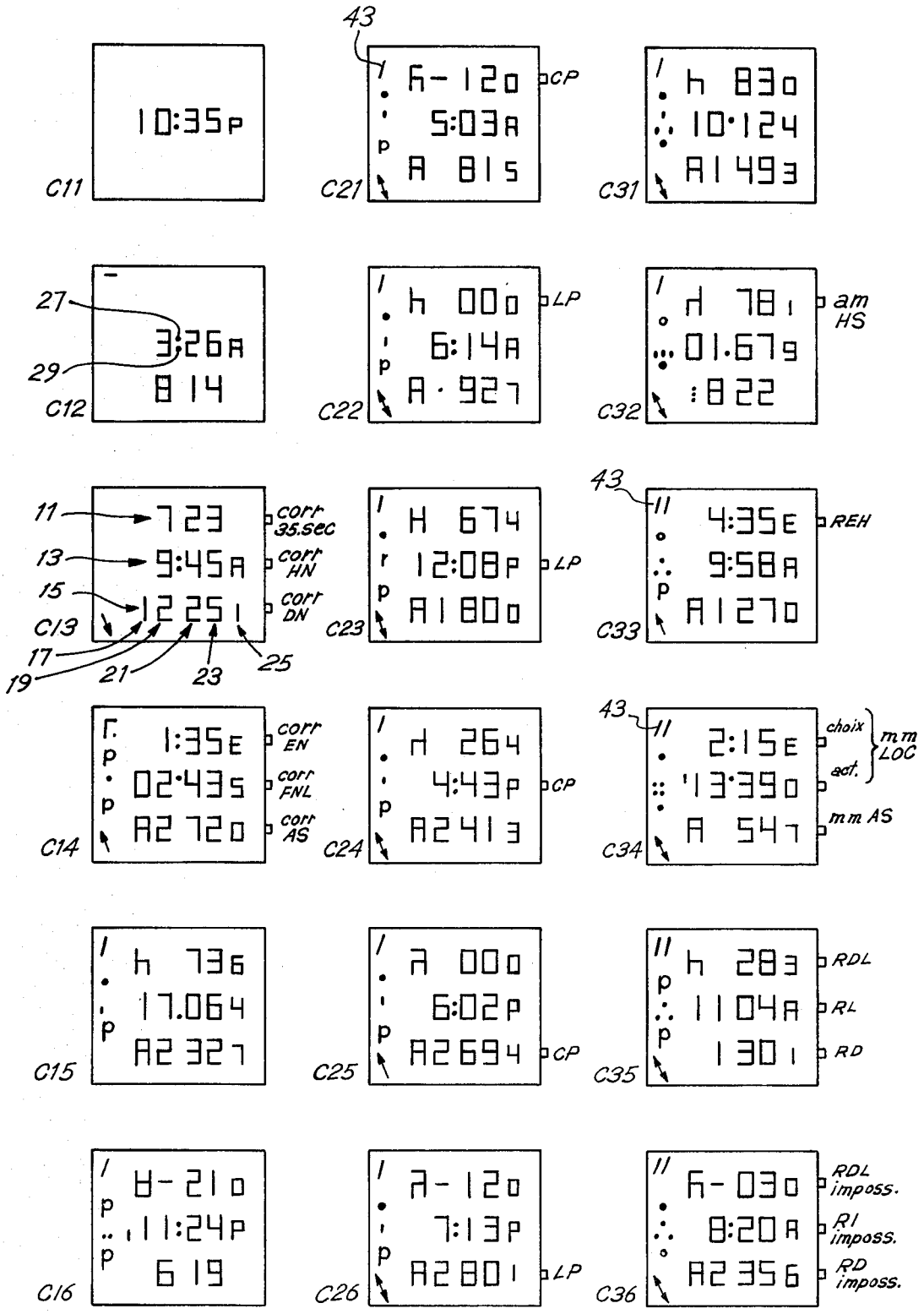
FIG. 2 shows a series of displays C11–C16, C21–C26, C31–C36 which the watch can provide in its various possible modes, in its different states of no correction, of forward correction, of back correction and of panel operation, for different postulated uses; of course

The example C11 of FIG. 2 shows the watch in its ordinary function, which is the simplest, wherein it only shows the hour and the minute for a twelve hour cycle plus the indication of A.M. or P.M. In the example C11 of FIG. 2, the watch indicates the time 10:35 PM.

As shown in FIG. 2, the watch may display up to three parallel lines of data, the upper 11, center 13 and lower line 15. Also wholly on the left is a series of symbols indicating the mode, the situation and other particulars relating to the three states within the scope of panel operation. Each of the three lines 11–15 comprises four main display sites 17, 19, 21, 23 of seven segments, an auxiliary display site 25 with seven segments located all the way to the right and two display sites 27, 29 separating the main left sites 17, 19 from the main right sites 21, 23. Referring to FIG. 1, six push-buttons 31, 33, 35, 37, 39, 41 are distributed on the sides of the watch case, three on the left (BPH', BPM', BPB') and three on the right (BPH, BPM, BPB). The extent where these push-buttons do not control the wholly general functions applying to the entire watch, the buttons will always control functions relating to the data displayed on the line at which the push-button is located. For instance in FIG. 1 the center line displays the time, 8:46 AM. The center button 39 on the right would be used to correct this time information in the event of a correction situation.

On the left at the top, the display comprises two almost vertical bars 43 (C33, FIG. 2) indicating the particular mode of the watch. When no bars 43 are actuated (for instance C11 through C13, FIG. 2), the watch is in the normal RN mode; when one bar 43 is actuated (for instance C21–C26 of FIG. 2), the I RTI panel mode applies and when two bars 43 are actuated (for instance C33–C36 in FIG. 2) the watch is in the II RTII mode.

To the left at the bottom, the watch may display an almost vertical bar 45 (FIG. 1) either with one arrow tip pointing one arrow tip pointing down or two arrow tips pointing up and down. When there is no display at that location, the watch is in the no correction situation SCN; when one arrow pointing up is displayed, the watch is in the forward correction situation SCAV; when a downward pointing arrow is displayed, the watch is in the backward correction situation SCAR; and when a bidirectional arrow is displayed the watch is in the panel operations situation STT. The meanings of the other symbols displayed on the far left will be made clear hereinafter.

Figure 8:
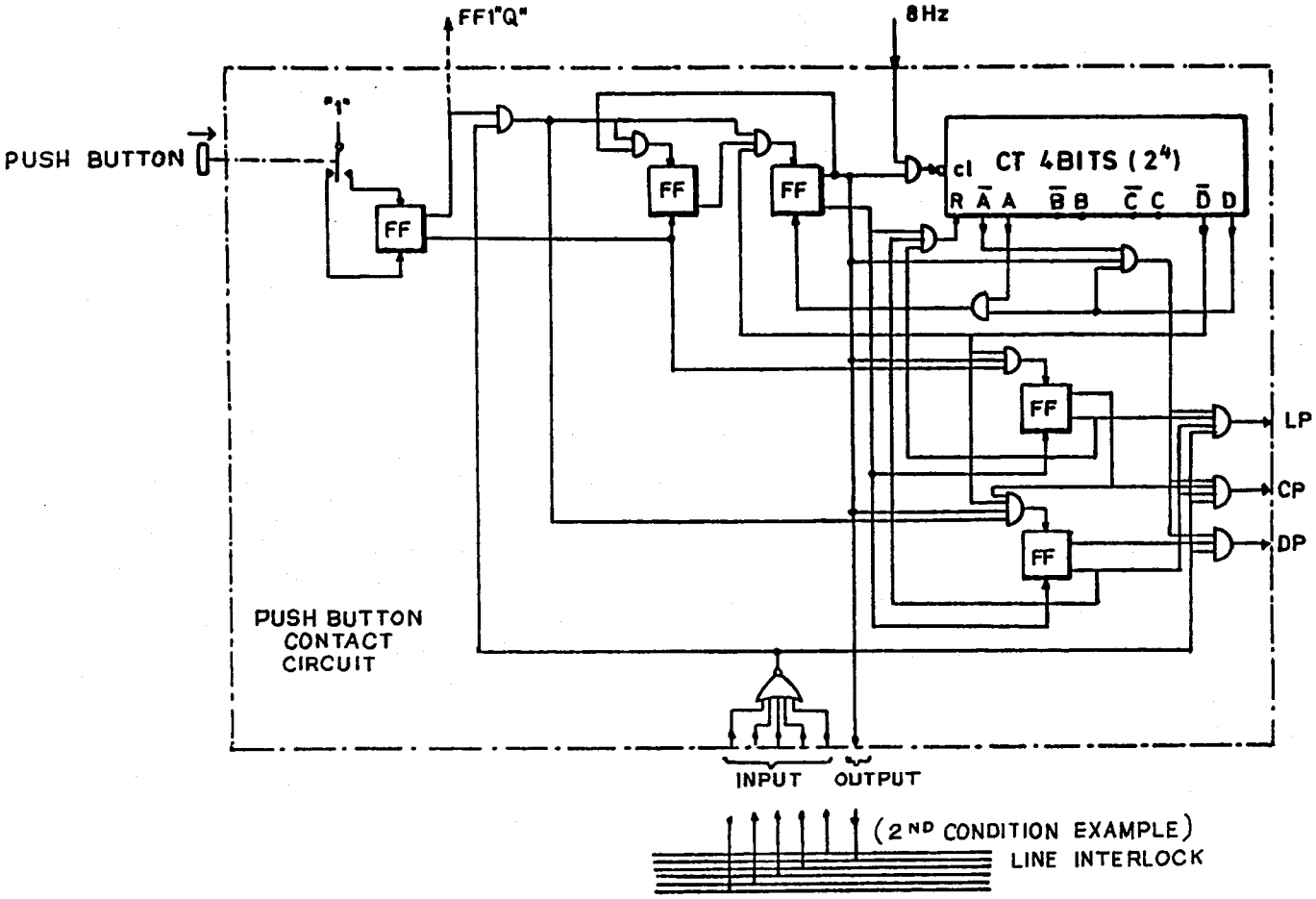
FIG. 8 is a more detailed diagram of one of six identical "command input" or "push button" circuits shown in FIGS. 5*a* and 5*b*.

To multiply the control possibilities provided by only six buttons, provision is made (as shown later in relation to FIGS. 5 and 8), for input command circuits discriminating between a push-button "briefly depressed then released" (short pressure), "depressed at least for one second before release" (long pressure) and "depressed, then released, then depressed again within one second" (double pressure). Each of these three types of actuation provides a distinct command, whereby it is possible to input eighteen different instructions with the six push-buttons. In all modes and all situations (except for a correction being in progress), a short depression of a left pushbutton advances by one step the kind of data on the corresponding line. In the normal RN mode (C11, FIG. 2), because the center line displays only a single kind of data, to wit the present time, a short depression of the center left push-button is without effect. On the other hand, the upper line as desired either displays no data (for instance C11, FIG. 2) or else displays the day of the week and the second (C13, FIG. 2). In the normal mode a brief depression of the upper left button BPH' causes the display of the day of the week and of the seconds to flash on and off. The same applies to the lower line which displays the date in month, date, possibly year (0, 1, 2, 3) of the four-year cycle when in the correction situation; the display of the date appears and disappears in the normal mode whenever a brief pressure is exerted on the lower left button BPB'.

When in the panels mode, the cycle of the three lines is as follows: upper line: "hour deviation" EH, "sun elevation" HS; center line: "time zone, latitude" FHL, "hours and minutes" HT; and lower line: "date" DT, sun azimuth" AS. This arrangement is the same for the two panel modes RTI and RTII.

It is seen that in the panels mode, the center and lower lines once present the same data as in the normal mode and at another time present another data, and that only the upper line when in the panels mode presents two data other than shown in the normal mode.

The normal mode operation is quite simple, the watch displays either uniquely the present time (C11, FIG. 2) or the present time with one of the data "present date" or "day of the week, seconds" (C12, FIG. 2), or the present time and both of these data (C13, FIG. 2). To correct them if necessary, the watch must be set in the forward or backward correction situation. A long depression of the lower left button BPB' causes the forward correction situation SCAV and the next pressure the backward correction situation SCAR, and the pressure thereafter the panel operations situation STT, and the next pressure returns the situation for no correction SCN. Once the correction situation has been established (for example C13, FIG. 2), a short depression of the right push button 41 advances (or sets back) the unit information by one step, that is the last right main digit of display site 23. A long depression on push button 41 advances by one step the digit located just to the left of the two dots (display site 19), and a double pressure (depending in the case) causes either an advance (or a set-back) by one step in the auxiliary information in display site 25 entirely to the right, or else an advance by one step of the decades in the second main digit from the right. As shown further below, in order to facilitate certain settings, a long depression of the right push button 41 following a short or double depression in the correction process advances by one step the digit of the decades to the right of the two dots in lieu of the digits located left of the two dots. Every time a correction is effected but incomplete, it must be acknowledged by a short pressure on the left push button of the particular line. As long as the correction is unacknowledged, it will be considered incomplete and it is impossible in particular to pass to a situation other than that of forward and backward commands. It is obvious that the brief acknowledging pressure causes no shift in the type of line display, and this is the above cited exception. Moreover, while corrections are under way, it is very easily possible to pass from the forward to the backward correction without each time passing through the operational panel situation STT and the no correction situation SNC. The moment all the initiated corrections are acknowledged, the four-position cycle to command the corrections (long depression of the lower left pushbutton, which is monitored by the lower left arrows) again applies.

The normal RN, I RTI and II RTII panel mode is selected by long pressures on the upper left button BPH'. The sequence is: RN, RTI, RTII, RN . . . . The panel symbol, imitating the I and II characters 43 at the top left, appears correspondingly. A special consequence of the presence of a correction as yet in progress and not yet receipted is that it is no longer possible to pass from the normal to the panels mode and vice-versa. Thus, if in the normal mode, this will remain to be the case, regardless of any long pressure on the upper left button, and if in the panel modes, the long pressures on the upper left button cause a transition from panel I to panel II, then from panel II to panel I, etc.

Be it noted that the corrections undertaken always apply to the data being displayed.

C13 of FIG. 2, for instance, is in the situation of backward correction. At C12 of FIG. 2, a small line which may subtend an angle with the RTI symbol bar 43, indicates that the I RTI panel mode which might be called for will be of a special type "without automatic alignment", which is a peculiarity discussed further below.

After a long depression of the upper left button BPH', the I RTI panel mode is acquired and the display of a bar 43 appears at the top left. When the RTI panel mode appears, always the first cycle data will be displayed, that is, the time deviation EH will appear on the top line 11, the time zone on the center line 13 and the data DT on the bottom line 15. Regarding the time and the date, a distinction is made between the DT panel date and the DN normal mode date, and between the HT panel time and the HN normal mode time, even though they are displayed on the same lines (but not under the same conditions).

The center line indicates at display sites 17, 19 the time zone from zero to 24 in accordance with convention. The latitude is given in degrees by the two main right display sites 21, 23 and in tenths of degrees by the auxiliary display site 25 entirely to the right; the upper of the two dots (at 27) indicates a northern latitude and the lower one (at 29) indicates a southern latitude.

The time deviation (upper line) directly shows in hours and minutes the longitude of the point considered with respect to the center of the time zone indicated. When the official time at the point considered is that of its proper time zone, the maximum time deviation is +/− 30 minutes, the deviation at the center of the time zone being 00. On the other hand, when a point is at the official time of a time zone other than the one it is located in (for instance in summer Brittany is at the time of the time zone 2 whereas it is located west of the time zone 0), it may incur time deviations exceeding one hour. The advantage of thusly expressing this longitudinal position is that the measurement is independent of latitude and more familiar to the user. It also offers the advantage that passing to summer time is implemented merely adding a time zone rank and one hour of time deviation. When looking for geographic positions as a function of the solar charts,—as discussed more comprehensively below—use again is made of the time deviation; for the sake of convenience, however, the time deviation has been limited to plus or minus 6 h 59 minutes. Accordingly the regions which may assume the official time of a given time zone as permitted by the watch extend across six time zones on either side of the particular time zone, that is, over half the earth's circumference. To express the other positions, it will be necessary in any event to refer to the antipodal time zone. Thus for instance every site in the world may be designated by reference either to the Greenwich meridian (time zone 0) or to the 180 meridian of the Aleutian isles (time zone 12). In fact, the official time zone rarely deviates more than 3 hours from the local time; it is known in any place what the time in the local time zone is, and it is further known how much the actual noon is late or ahead with respect to the center of the time zone.

Thus the three data EH, FHL and DT determine the place in longitude and latitude, and the date of the place considered. When passing to the second position of the display cycle, while still in the panels mode, there is obtained the sun elevation on the upper line, the time on the center line, and the sun azimuth on the lower line. Under these conditions, if the time remaining on the center line is the actual time, and if the geographic point of the watch is set for the place where the user is located, the upper and lower lines respectively, automatically will show the sun position in height and azimuth at the very instant and present place. The two data of azimuth and solar elevation, AS and HS will be corrected every minute, simultaneously with the data of current minutes. However it is possible to decouple the display time from the current time and to cause to appear for instance on the center line another time of the day by means of a forward or backward correction. The moment this correction has been confirmed (acknowledged), the computer part of the watch becomes functional and automatically realigns the AS and HS data (azimuth and elevation of the sun) as a function of the new time. Similarly the azimuth data AS or the solar elevation data HS can be corrected, the two other data realigning automatically with respect to the one that was just corrected the moment the correction is acknowledged. This constitutes the wholly original peculiarity of the watch functioning in the I RTI panel mode. In this mode too the sun elevation for instance may be made to appear on the upper line, the time on the center line, and the date on the lower line. If the last realignment was made with respect to the time, or if there has not yet been a realignment, any modification of the date automatically will cause a realignment of the solar elevation data as a function of the date, the time being kept. At the same time, the solar azimuth data, which temporarily is not displayed but nevertheless is present, also is realigned on account of the new date. In this manner for instance it becomes possible to know the solar elevation at a given locale for any day of the year. If the last alignment prior to the date correction for instance was made with respect to the solar elevation, the realignment as a function of the date will be made while keeping the solar elevation and redetermining the time at which, for the new date, the sun shall be at the set elevation (for instance 26.4°, fourth prayer hour of the Moslems).

In the I RTI panel mode, MONOBLOC corrections are possible, in which particular predetermined solar elevations HS are involved. The elevations are displayed without the need to correct the HS value step by step. There are three main "monobloc" positions, namely sunrise, the sun at its meridian (maximum elevation) and sunset. These three particular sun positions can be displayed, the first one, ie sunrise, by a long depression of the upper right BPH button, the second i.e., noon, by a long depression of the center right BPM button, and the third, ie sunset, by a long depression of the lower right BPB button. These three particular positions will be significant to practically all users. Moreover, there are three positions most important to the faithful of the Moslem religion, namely the position "dawn", where the rising sun is still 18° below the horizon, the position "descent" where the setting sun is 26.4° still above the horizon and "dusk" when the setting sun is 18° below the horizon. These three positions may be respectively summoned, the first one, namely dawn, by a short pressure on the upper right BPH button (the position adjacent to sunrise, same button), the second, descent, by a short pressure on the center 3BPM button (the position adjacent to noon, same button) and the third, dusk, by a short pressure on the lower right BPB button (position adjacent to sunset, same button). These "monobloc" emplacements occur in the panel I mode in the panel operations situation STT regardless of the displays that are present at the time the corresponding buttons are actuated. The displays on the center and lower lines remain as before, that is, if by chance and for instance the lower display is the date, the data shall remain displayed, while nevertheless the solar azimuth AS shall be emplaced and appear the moment the azimuth and not the date shall be displayed on the lower line. The same applies to the center line. On the other hand, the monobloc corrections mandatorily display on the upper line the solar elevation HS, as this display allows recognizing the monobloc positions.

It is appropriate here to state how to display the solar elevation depending on the sun rising or descending or yet being at apogee or perigee. In case of solar elevation HS display on the upper line, the two main right digits 21, 23 denote the solar elevation in degrees (maximum 90°) and the auxiliary digit 25 all the way to the right shows the tenths of a degree. The digit located directly to the left of the two dots (which do not appear in this display) is reserved for the symbol "−", ie for the elevations below the horizon. The last digit on the left displays an "h" when the sun is ascending and nearer noon than midnight, ie in the morning. When the sun is rising but closer to 00 h than to noon, the h is provided with an upper horizontal stroke as shown in FIG. 2 at C21 for instance. Thereafter, as the sun reaches its maximum position (meridian), the symbol becomes an "H" as shown in FIG. 2 at C23 for instance. Next, as the sun redescends, still being closer to noon than to midnight, the "h" inverts to become " "; this is shown in FIG. 2 at C24, for instance. Lastly, as the sun drops and when closer to the end of the day than to noon, the "h" is provided with an upper stroke to become "h" as shown in FIG. 2 at C25. Next when the sun is at the minimum below the horizon (true midnight), the "H" is provided with a lower stroke, assuming the shape of "H" as shown for instance at C16 of lower FIG. 2.

Be it noted that regarding the positions "H" and "H", there is no need to indicate the elevation value, merely the maximum or minimum is indicated, the watch taking care of computing the elevation.

The monobloc corrections are restricted to applying the desired value of the solar parameter HS, together with the desired sign, the computer taking care of the rest.

The center column of FIG. 2, ie the positions C21 through C26, illustrates the six successive monobloc positions. These can be recognized by the following HS values: "h" (or h) −18.0"; dawn, "h" (or h) 00.0"; sunrise, "H . . . (any value computed by the watch)"; noon, sun at meridian, "26.4"; descent h (or h) 00.0"; sunset and " h (or h) −18.0"; dusk. This corresponds to the six positions of the central column in FIG. 2.

In the panels mode, the time and the date may correspond to the present time or be out of synchronization. All the way to the left and slightly above the center line (likely to display the time) and the lower line (likely to display the date), symbols either being "p" or "o" are shown. Passing from one symbol to the other is implemented by adding or erasing the vertical bar. This display takes place only in the screen mode. The "p" denotes the "present time", for the time and/or the date depending on the case. The other symbol "o" denotes the time is out of synchronization, regarding date or time depending on the case. Obviously the moment a time correction is activated, or a solar elevation HS to realign the hour, or an azimuth AS correction to realign the hour or else yet a "monoblock" correction to realign the hour are undertaken, the time indication in the panel mode I is automatically put out of synchronization. As regards the date, it will be desynchronized only if subjected to a correction (or a memory reminder, ie a function discussed further below). Be it noted that it is possible to desynchronize and resynchronize the time and the date resp. in the panels mode by a double depression of the left center and the lower left buttons respectively.

As regards the operation in panels mode, the time and the date are supported by operational registers distinct from the counter registers that determine the current time and date. In this manner it is possible to modify the position of the time and date for instance to ascertain the sun elevation three months hence at 7:30 AM without at all losing the current data of hour and time which automatically shall return by resynchronizing the date and/or the time and which mandatorily shall reappear when returning into the normal RN mode.

If, when using the watch being discussed one passes from the normal mode (and in the no correction situation SNC) into the panels mode, the time and date data which first appear are not those from the operational registers but those from the normal time registers. By a very simple manipulation it is therefore possible to know the solar positions at the very time of inspection. If it is attempted to carry out a time and date correction in this situation, this correction will not take place, but instead, the time and/or the date are desynchronized. The next correction will be effective. Thereafter, when the date and the time are resynchronized (by means of a double pressure on the corresponding left button), the operational register is aligned with the time or current date counter, but the data are not taken directly from the current time and date counters. Desynchronization from the particular above-mentioned initial position also can be implemented by a double pressure exerted on the corresponding left button. The symbols "p" or "o" appear all the way to the left on the watch corresponding to the above description. Be it noted that these synchronization and desynchronization matters of the time and date data in the panel mode are dealt with in the same manner in the II RTII panel mode discussed further below.

The question of locale remains to be discussed. In principle, the watch memorizes three different locales each defined by a time deviation EH, a time zone FH value and a latitude value L. The watch includes three locale memories "LOC A", "LOC B", "LOC C". The information "LOC A" is that of the "home port", namely (except for one case to be discussed further below) the locale for the ordinary time in the RN normal mode. While the locale is not displayed in this mode implicitly however, it is the locale of the home port LOC A which matters.

In the panels mode, the home port LOC A is maintained at the beginning in the same manner as the ordinary time and date as mentioned above. Thereafter, the moment it is desired to correct for the locale or the moment a change in place is intended, it will be the locale operational mode which provides local information. Changes in locale are implemented in a cycle of four or five, by long depressions of the center button BPM'. They are monitored by a set of four dots located all the way to the left at the center between the two "p" marks. The four dots of this set approximately take up the three apexes and the center of the base of an isosceles triangle resting on its base (the slanting sides are equal). In principle, one dot mark denotes LOC A, two dot marks next to each other denote LOC B and three dot marks next to one another denote LOC C. Three dots as a triangle indicate that the operational locale no longer is determined by one of the three memories LOC A, LOC B, LOC C. Regarding the single dot denoting LOC A, if it be at the top (upper apex of the triangle), it means that this LOC A is that of the home port considered by itself at the beginning of the panels mode, whereas if this dot is all the way to the left on the base, it means the operational locale is synchronized with LOC A (as it might also be synchronized with LOC B, or LOC C, or also by unsynchronized). Except for the fact that the register of the home port LOC A is not subjected to an automatic change every minute or every 24 hours, it assumes the same role as the ordinary time and date counters.

In theory accurate timekeeping is carried out in relation to the time most set back of the planet, ie of the time zone 12. In the registers, the time zones are countered in such a manner that the time zone 12 have the value zero, that the time zero 0 (Greenwich) have the value 12 and that the time zone 11 (Australia, New Zealand) have the value 23. Moreover, to take into account that the last time zones might introduce summer time, even double summer time, or time in advance by three hours, provision has been made for time zones 24, 25, 26 denoted as 12', 13', 14' in the display, where the prime sign when occurring being located in front of the figure 12, 13, 14, on the left center line of the watch.

The transformation of the time zone notations takes place in simple manner in the display, a weighting bit 12 being inverted. When the time zone to be considered has been modified, the ordinarly time—ever computed for the time zone of the greatest lag—is increased by a number of units equal to the rank of the time zone (depending on the particular above-mentioned series). Thus, the home port data, even though it is not supplied in the normal mode, depends on providing the current time and date data of the home port locale, that is, the hour information provided in the normal mode. However, without leaving the normal mode, it is possible to provide briefly by means of the center display line of the watch the time, not at the home port locale but at the present locale in the operational register. To that end it is enough when in the normal mode to exert a long pressure on the left center button BPM' which, for the panels mode, is used to change locales and which, in this instance, as long as it is depressed beyond the first second, causes the displayed replacement of the home port locale by the locale contained in the operational register. This provides a convenient way of always knowing and without other actuations of the watch what time it is in an important locale, for instance in New York for a Swiss businessman having interests in New York, or in Cairo for an Egyptian resident of Hong-Kong.

The purpose of the eighteen command means in the normal RN mode and the I RTI panel mode have been approximately described. However the purpose of a double pressure on the upper left BPH button must yet be discussed. In the normal mode such a double pressure causes the preparation of the special panel I mode and then, where called for, its release etc. This is denoted by a short stroke at the top left, as shown in FIG. 2 at C12. In the panel I mode, such a double pressure has only one effect, namely to suppress the special panel I mode to return to the normal panel I mode. Moreover, such a double pressure in either of the panel modes and when all the displays are at the second cycle position (HS, HT, AS), will cause the return of all displays to the first position (EH, FHL, DT). When not all the displays are in the second position, a first double pressure on the upper left button brings them back to the second position, and the next double pressure returns them to the first, etc.

Also, the role of a double pressure on one of the right hand pushbuttons in the panels mode and in the STT panel operations situation remains to be dicussed. Such a command induces a "memory-call" of the data displayed on the line in question. The term memory-call means feeding data previously memorized to the corresponding operational register, to the operational time, date, AS azimuth and HS sun height registers, all comprising an auxiliary memory of which at any time the desired content may be retrieved if desired. The write-in for the auxiliary memory of the registers is possible only in the panel II mode as explained further below. The memory call on the other hand applies to both panel modes provided the situation be of transfer into STT panels (denoted by a double arrow at the bottom right). It will be remembered that the special panel I mode (RTIS) is similar to the panel I mode except that the automatic alignments do not take place. If then with this special mode in effect for instance a monobloc call is made, the solar elevation data will be written on the upper line, but the two data of time and azimuth will not be realigned.

It will also be noted that the panel I mode allows introducing inacceptable values. For instance as shown at C15 in FIG. 2, there may be no solar azimuth 232.7 (measured from the north towards the east) for a latitude 6.4° south if during the summer. This is so because at such a latitude and during the summer months (May, June, July, August) the sun remains day and night in the northern hemisphere and its azimuth never will be between 90° and 270°, but always beyond 90° or 270°. In the case illustrated at C15 in FIG. 2 the watch detects the data are impossible to process and indicates this by flashing the two lower vertical segments which are at the extreme left on the upper and lower lines as indicated by the dashed lines in the view C15 of FIG. 2. Other conceivable "operation impossible" or "banned" exist, and the watch translates all of them into a flashing of these two segments.

When in the II RTII panel mode, the functions of the left hand buttons remain the same as for the panel I mode (except that a double pressure on the upper left button no longer can cause the special mode I as its effect at this point is null in the RTII mode; however its assembling effect in position I or II of the display cycle is just as active for the II RTII panel as for the I RTI panel. Regarding the right-hand buttons, their functions differ in the panel II mode. First, in this panel II mode, there is no automatic readjustment between the three variables "time" (HT), "solar elevation" (HS) and "solar azimuth" (AS), the date and the time acting as parameters but in this panel II mode, all values can be written-in and corrected at will without mutual realignment. On the other hand, it is possible in the panel II mode to search on the basis of solar azimuth AS and elevation HS determinations at a given instant, not necessarily but advantageously known. In this panel mode, three searches are possible, namely the date search RD, the latitude search RL and the date and latitude search RDL. When the latitude is assumed known, the date search permits calculating the effective date on the basis of a solar determination (AS, HS). This date search is triggered by a short depression of the lower right button. The latitude search for known and accurate date allows searching the latitude on the basis of a solar determination. It is triggered by means of a short depression on the right center pushbutton BPM in the panel II mode with the panel operations situation STT. Lastly the search for date and latitude RDL is commanded by means of a short depression of the BPH push-button in the RTII mode and in the panel operations situation STT on the basis of two solar determinations, both the date and the latitude being assumed unknown and to be found. Regarding this last seach, first the determination of the first "HS, AS" is set on the upper and lower lines, whereupon these two values are stored (in a manner explained below) and the HS and AS values of the second determination are introduced, whereupon a short pressure is exerted on the upper right button. If the center line then displays the time zone and the latitude, the latitude of the local where the determinations were made will be automatically marked. Otherwise, it will be present waiting only for the display of the latitude to be displayed. The date is processed in the same manner. Be it noted that once the azimuth of the second determination has been introduced on the lower line, it is possible to display on this line the date, the azimuth present but not displayed being similarly used for the search.

The formulas used for the various alignments and searches are contained in the computer which will be discussed further below, in conjunction with the discussion of the internal watch circuits.

For the II RTII panel mode in the operational situation in RTT panels, a double pressure exerted on a right-hand button causes a memory call similar to the case for the panel I mode. A long depression of these buttons causes storing the data displayed on the corresponding line to the extent such data can be stored. The values of sun elevation HS, operational time HT, operational date DT and solar azimuth AS all can be stored in an auxiliary memory of the corresponding register. The values of time deviation EH and of time zone latitude FHL, which together are the local data can be stored in the three locale memories LOC A, LOC B, LOC C to the extent that only simultaneously the two data, EH on the upper line and FHL on the center line be present. When this is the case, the long depressions of the upper button BPH provide the choice between the locale designations to be resupplied into locale data, that is between LOC A, LOC B, LOC C, and a long depression of the center right button BPM causes the transfer to this location of the locale data displayed up to that time. In this manner it is possible, after a certain locale has been established, for instance by a latitude search, to store this locale for instance in LOC C or LOC A.

As regards the searches for date and/or latitude, the watch, after it has found the date and/or the latitude, determines at which time this determination should have taken place, and whether it was carried out at a longitude corresponding to the EH value contained in the watch with respect to the center of the time zone shown in the watch. If the watch shows an hour next to that which was effectively read as the current time at the time of the determination, it means that the EH value and the initial longitude are correct. If there are differences, the longitude position is incorrect, which then can be re-established by an EH search. This is done by bringing the EH display back on the upper line and writing-in on the center line not the time computed by the watch but that at the termination. Within the watch, the local times register keeps the time computed by the watch. A short depression of the upper right button BPH causes a time search EH, ie causes the watch to store a time deviation such that the local time stored within the watch (but nowhere displayed) does indeed correspond to the official time displayed and determined at the same time as the solar elevation and azimuth for position-finding. It is clear that if then an EH of approximately 6o'clock is obtained, it is proof that the proper time zone is not on the watch and that the time zone will be so corrected that EH be next to 0 h or 1 h.

Again an EH search also may be carried out, not following a search or alignment operation, but after positioning the local time register by the official time, which is implemented automatically when official time is stored. As regard the other conditions, an EH search is not required. Be it noted that if the EH search were to result in a time deviation exceeding 7 h, this would be reflected by a banned-operation flashing whereafter it would be necessary to use the antipodal time zone and start again. Be it also noted that as regards the date or latitude searches, it is possible to introduce fictional data into the watch corresponding to no latitude and no date. In this case, the watch itself detects these fictional data and provides an "inadmissible" indication as shown in FIG. 2 at C36. As a matter of fact, there cannot be an azimuth exceeding 180° when the sun is rising, in this instance the sun is still at an elevation of −3°, and the watch, having considered that one of the data is a morning data while the other is an afternoon data, refuses to undertake this impossible search and indicates this by the flashing shown in dashed lines on the screen C36 of FIG. 2.

As regards the LOC selection, where the place inscription must be made, it is indicated by a flashing of the dots which otherwise show the locale controlling the operation, that is, one flashing dot for LOC A, two flashing dots for LOC B (as shown in FIG. 2 at C34) or three flashing dots next to each other for LOC C.

Figure 3:
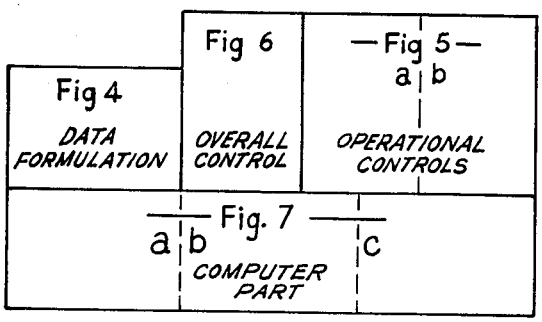
FIG. 3 schematically shows the overall electronics and logic diagram of the watch in relation to FIGS. 4, 5, 6, and 7.

The watch functions, as they appear to the user, have been shown almost in totality. Presently the internal structure of the computer watch will be considered. In the course of these explanations, certain external functions, so far not mentioned, will be considered, either in relation to the discussion of the drawing or in the drawing itself. FIG. 3 shows how the various watch circuit groups are subdivided, however, the subdivisions of the drawing being approximate, the interdependence of the circuits making it impossible to place them precisely in one group or the other. In general, the watch is provided with a double integrated circuit, i.e., an integrated circuit in two parts, one part comprising approximately what is shown in FIGS. 4, 5*a*, 5*b*, and 6, and the other in the form of a microprocessor comprising the desired components to implement the programs symbolically shown in FIGS. 7*a*, 7*b* and 7*c*. The integrated circuit may be either a large-scale circuit comprising one part of the type "LSI clock" for the components other than the computer, and the other part a "microprocessor" for the computer, or a two-level integrated circuit, one level for one part and the other level for the other part, however, with numerous interconnections made directly on the double integrated circuit. As a variation, two separate integrated circuit chips may be provided, with multiple interconnectors of the mille-feuille type automatically ensuring proper connections provided the two integrated circuits be sufficiently precisely superposed.

Figure 4:
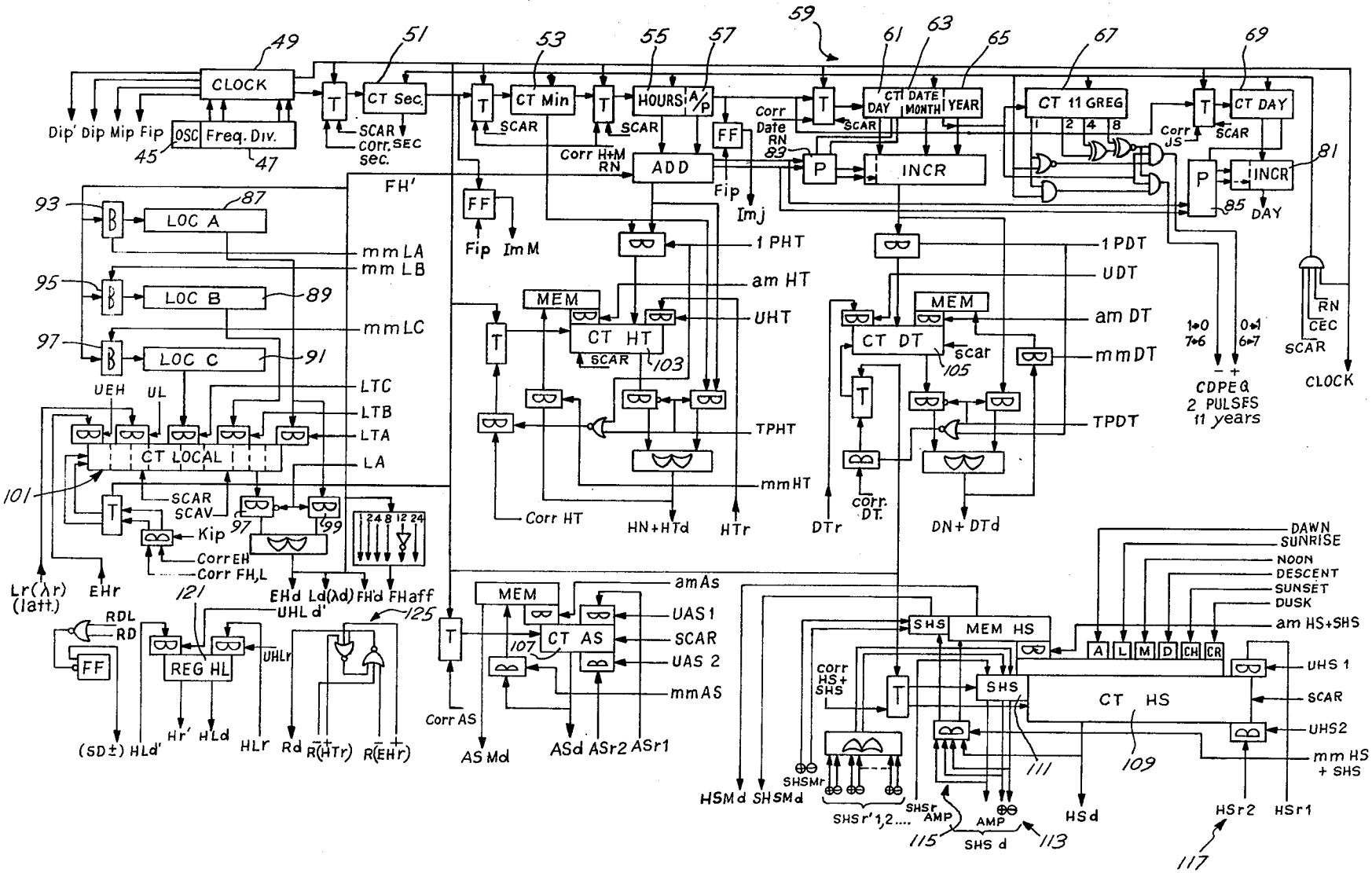
FIG. 4 is part of the watch schematic of FIG. 1 showing the set of circuits formulating and storing data of time, date, place, local time, sun azimuth (AS) and sun elevation (HS) which are to be selectively displayed.

FIG. 4 shows a quartz crystal oscillator 45 feeding a frequency divider 47. The frequency divider feeds a clock circuit 49 which generates all the pulses in the proper time relations needed for the watch's operation. This clock circuit in particular generates second pulses for the operation of the current time counting circuitry. These second pulses are sequentially counted in a second counter 51, a minute counter 53, an hour counter 55 followed by a binary A/P counter 57, a date counter 59 comprising a counting means 61 for the number of the day, a month counter 63 and a year counter 65 in an annual cycle for the leapyear cycle. The date counter 59 automatically sets up the count of the day of the month as the number of days as a function of the month and as a function of the year for February. The date counter is followed by an "11 GREG" counter 67 counting an 11-year cycle for the "Gregorian corrections" affecting the precise time of the spring equinox. It is known in this respect that the Gregorian calendar, which skips three leapyears in 400 years, advances the precise spring equinox time with respect to a leapyear (a respective shift of 6,12,18 h for the three years) by about 2 h every 11 years. The "11 GREG" counter provides two pulses every 11 years which update an adequate memory contained in the computing part. Lastly, the counting chain for time comprises a days-of-the-week counter 69 with a seven-cycle and receiving one pulse a day like the date counter. All these counters are shown in the upper part of FIG. 4. A stage denoted by T receives clock pulses, the correction data for the next counter, and also SCAR reporting a backward correction situation. The T stage precedes each counting stage 51, 53, 55, 59, 67, 69. These T stages set up the appropriate time relations for the transmission of pulses to all the counters, which counters are synchronous. The clock signals are based on periods of precisely $\frac{1}{8}$ of a second and which due to binary division comprise 128 periods of about 1 ms (1/1024 sec precisely). These "ms" themselves divide into "microseconds", this unit being the operational scale for a computer. The first of the 128 ms is set aside to implement various circuit conditions for the various functions. The following ms cover the transmission of the normal advance data for the ordinary-time counting-chain. Thereupon the corrections applied by each preceding stage T to each counter are impleted, i.e, during the third ms or during the fourth ms depending on a forward or backward correction being involved. The counters of the current time counting chain are bidirectional and inherently forwardly counting. They receive information (the input shown on the counters in FIG. 4) whereby they pass into the backward counting situation during the fourth ms where there exist simultaneously the normal RN mode (permitting to correct the current time counting chain), the backward correction situation SCAR and the dertermination that a correction is in progress (CEC). In this case, the corrections will act backward no matter what they are. The fact of making the counters pass into the backward counting situation only when absolutely necessary avoids having very many switching operations that for most cases anyway would be superfluous. Such synchronous counting chains have been sufficiently described, and therefore there is no need to discuss them more comprehensively. Regarding the "11 GREG" counter 67, the four weighting bits 1, 2, 4, 8 and the gates 71 combining them to obtain a positive pulse at 73 for 0 to 1 and 6 to 7 transitions are shown, and, for the case of backward counting, a negative pulse at 75 for 1 to 0 and 7 to 6 (CDPEQ pulses).

In FIG. 4, the time-zone FH' data (starting at 0 at the time zone 12, which is the most late) is applied to a static adder 77 also receiving the hour information. The hour information, which initially was set up for the most late time-zone, therefore is advanced in the desired degree to provide the time of the time zone considered. It was noted above that there are time zones 12', 13', 14' which, as regards the count starting from the time zone 12, respectively provide 24, 25 and 26 hours' advance. The FH∝ data is a twelve-cycle pulse a weighting bit 12, plus a weighting bit 24. Therefore there may be on occasion two instead of one addition carry's. They are fed to incrementing stages 79, 81 which increment by one or two the data of date and day of the week. These incrementers, just like the adders, are of known type (they consist of three-input stage adders, one weighting output identical with the inputs and one weighting output double that of the inputs), however preparation circuits 83, 85 are being required for incrementers 79, 81 in view of the cycles of the days of the month and days of the week being shortened by one power of two. For instance the counter of the days of the week is an octal counter (0 to 7) designed that the position I, not 0, automatically follow position 7. When one or two units must be added to the position 7 or when two units must be added to the position 6, a third unit must be added so that the incrementer also skips the position 0. The stage 85 for the incrementer of the days of the week therefore is an ordinary "three inputs- two outputs" adder furthermore comprising a gate admitting the input from the counter 7 position only when one of the two other inputs (adder carry) commands an increment of one unit. A similar design is present in the preparation stage 83 of the date incrementer; latter receives adequate commands from one of the positions 28, 29, 30 or 31 depending on the length of the current month.

The hour and date set-up as just explained offers the advantage that when increasing the information of the time zone to be considered, the hour information automatically advances, the time therefore always remaining adequately conserved.

The left of the FIG. 4 shows memories 87, 89, 91 for the data LOC A, LOC B and LOC C. These memories are fed by means of gate-circuits 93, 95, 97 allowing to introduce locale output data by the respective commands mmLA, mmLB, and mmLC. The drawing shows blocks 93, 95, 97 in the middle of which is represented a double AND gate (forming a B where vertically arranged) and which are AND gate circuits with a plurality (as many as needed to transmit all the required bits) of AND gates, all controlled by the input of the gate circuit. The locale data output is provided by an arrangement of selection gates formed by two complementarily controlled AND gates 95, 97 followed by an OR gate 99. One of the AND gate circuits passing 95 into the RN normal mode and possibly at the beginning of the RT mode, transmits the LOC A data (home port locale) while the other 97, conducting when the first is not, transmits the local data from an operational locale counter 101. It will be noted therefore that provision is made for various gate circuits and connecting input circuit allowing locale counter 101 to assume independent values or also to align itself with one of the three LOC or again to detect data from the computer ($EH_r$, $L_r$( $_r$)(latt.). The computer processes the data from the transformed time zone (0 west of Alaska, 12 at Greenwich). On the other hand, the display shows the time zones in the conventional numbering. To that end, the data FHaff is obtained by transmitting directly the bits 1, 2, 4, 24 of the time zone signal and by transmitting inverted the bit 12 of this signal.

The FIG. 4 also shows an hour counter 103 for panels operation and a date counter 105 for panels operation. Here again a system of gate circuits similar to that described for the locale memories and at once understood by the artisan in relation to FIG. 4 allows these counters to have their contents synchronized with those of the current time counter or to be at their proper value which is either drawn from the auxiliary memory (amHT, amDT) commands or obtained from corrections or due to alignment with data from the computer (UHT, UDT commands). Storage also is assured by adequate command signals acting on the gates.

The FIG. 4 furthermore shows the solar azimuth values counter 107 which may be aligned by memory call, by correction or by implanting the contents from the computer (from two of its sites, $AS_{r1}$ and $AS_{r2}$). Be it noted that the information about the backward correction SCAR is applied not to the command stage T but directly to the counter, in order to set the desired count, for all the operational elements which need not ensure the advance of the ordinary time simultaneously with the corrections.

Again FIG. 4 shows the operational counter 109 for the solar elevation. Whereas the azimuth counter 107 counts from 00.0 to 359.9 and always in positive values, the solar elevation counter 107 counts in tenths of a degree from 0.0 to +90.0 and −90°. Also, this solar elevation counter is associated with an SHS counter 111 (HS sign) operating in hexacycle for the six symbols "H", "h", ".H", "..h..", " ", "H", allowing the display of the various segments of the solar path. The arrangement of the sun elevation counter 109 is similar to that of the solar azimuth counter 107, except for the SHS part (also present in the conjugate memory) providing a data ⊕⊖ at 113 which distinguishes the "h;" "H"; "H" from the "H"; "H"; "H" group and also at 115 the A,M,P information (ante meridian, meridian, post meridian) bounding the path segments in the east (H, h), the two meridian positions (H, H) and the path segment in the west (H, H). This six-position circuit SHS can be reset by a large number of data ($SHS_{r1,2}$ . . . ⊕⊖ and by a data $SHS_r$AMP). Also the reset ⊕, ⊖ will affect the SHS part of the memory; this is the only case for the watch where an adjacent memory receives external commands other than the setting for normal memory.

To be aligned, the solar elevation counter 109 receives at 117 two distinct data from the computer, $HS_{r1}$, $HS_{r2}$ and it also receives at 119 the six monobloc commands: "dawn", "sunrise", "noon", "descent", "sunset", "dusk". Every time and by means of connections internal to the counter, the desired sun elevation position (for noon, the position SHS=H) is set in a manner equivalent to what would be obtained otherwise by step by step value corrections, i.e., a much more laborious procedure.

The circuit of FIG. 4 also comprises a local time register 121 which only receives data from the computer and provides data to it; be it noted that register 121 is so designed that it will supply to the computer (and receive from it) on one hand the hour and minute information in hours and minutes and on the other hand this information is transmitted in the form of angles (15° for one hour, $\frac{1}{4}°$ for one minute). The FIG. 4 also shows a flip-flop 123 providing data, (SD +/−) distinguishing the possible dates when a date search is underway. Moreover, another RS type flip-flop 125 is provided which is made up of two gates, receives data $R_d+$ and $R_d-$, and provides an $R_d$ data where this information, coming from the computer which uses it in some cases and being displayed jointly with the time information when present, indicates that the time found is not that of the particular day in question but of the solar path for the day in question wherever this distinction is required by a significant time deviation EH. This case is illustrated in FIG. 2 at C16. Here the sun at perigee situation was sought. By definition, the day begins at perigee, local time 00 h 00 min., and ends just before the next perigee, local time 23 h 59 min. In this case, the sun passes perigee at 21.0° below the horizon (northern country on 19 June) and if the shift were zero, the official time 0.0 would obtain in harmony with perigee transit. The locale considered being located 36 min. east of the time zone center at the official time at which it is, this perigee transit takes place at 23 h 24 (11 h 24P in the US notation used herein) and this is 11 h 24 PM of 18 June and not of 19 June, in spite of the indication on the bottom line. This distinction is provided by the lower vertical bar all the way to the left of the center line (never used to indicate hours in this manner). Its activation is provided by the signal $R_d$ seen at the bottom of FIG. 4. Be it noted that for a conventional 24 h display, the discriminating mark in question might be placed all the way to the right as the A/P indication would not be required.

Figure 5A:
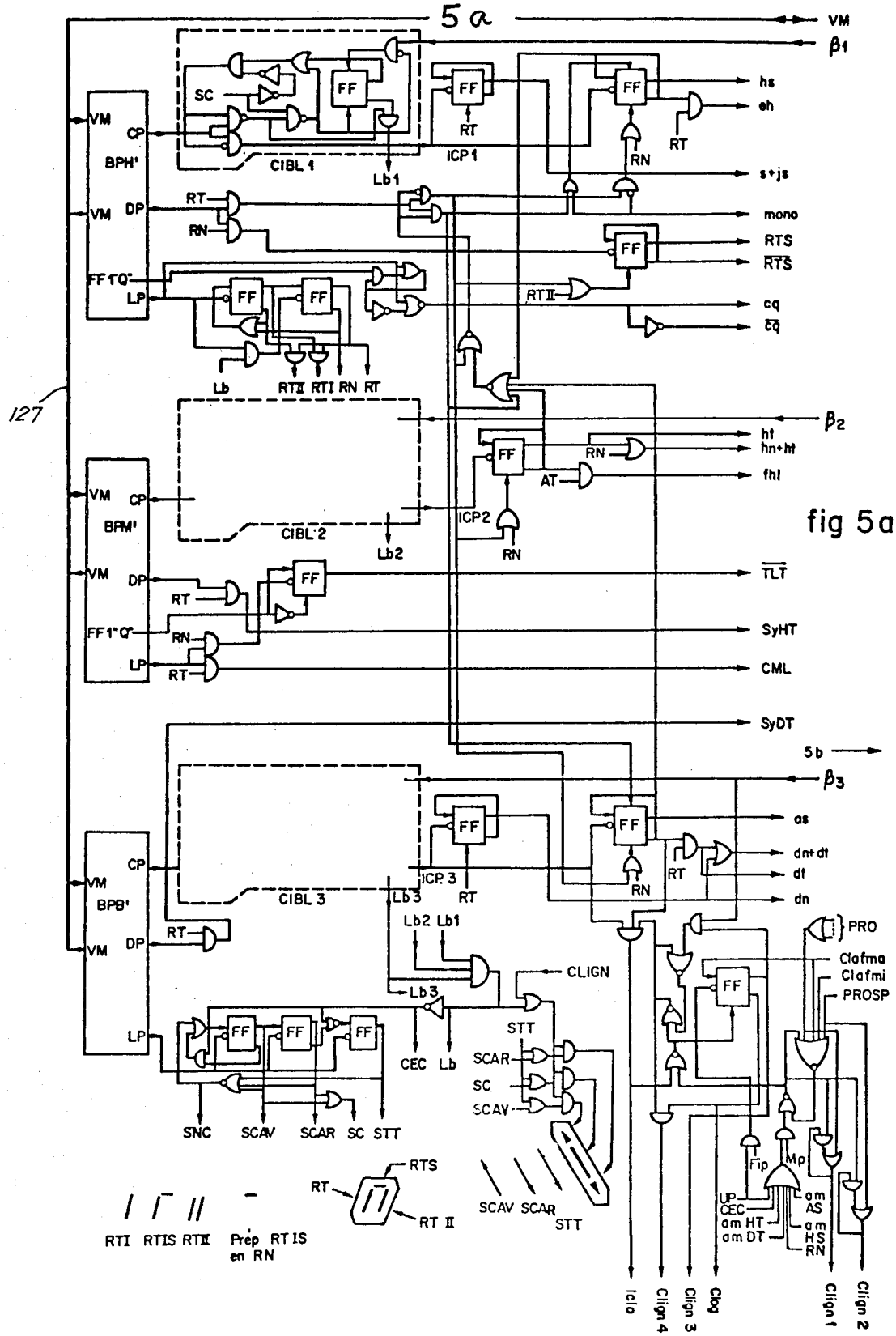
FIGS. 5*a* and 5*b* show watch circuit diagrams comprising control circuits connected to operational controls and a certain number of auxiliary circuits for different functions.
Figure 5B:
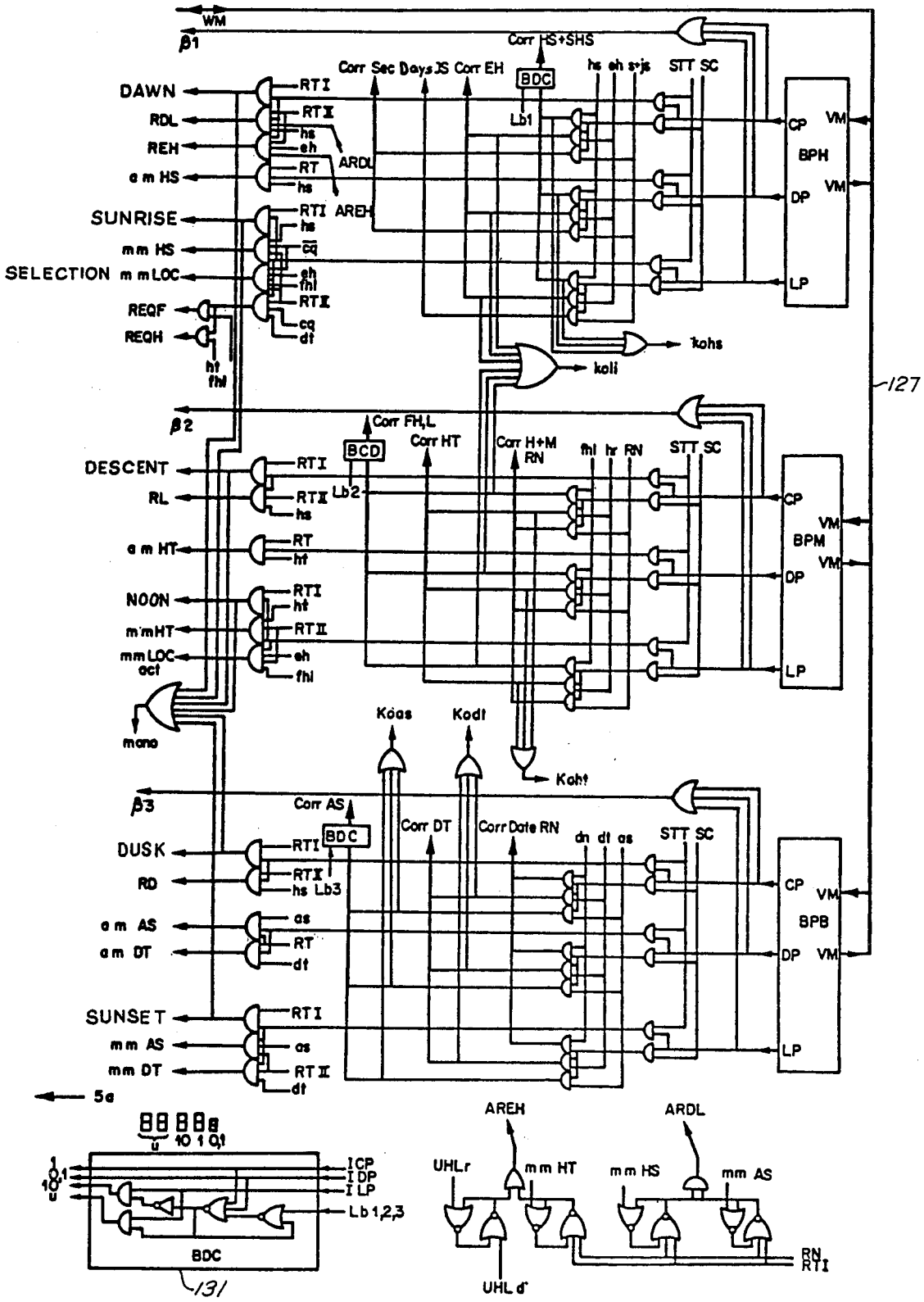

FIGS. 5*a* and 5*b* show six circuits of input pushbuttons with the same designations as the pushbuttons of FIG. 1. Internally these circuits all comprise the arrangement shown in the diagram of FIG. 8. This logic diagram is easily understood by the artisan and ensures an absolute discrimination between the three LP commands (long pressure), CP (short pressure) commands and DP (double pressure) commands. This diagram moreover shows an interlock by six VM lines, one determined by the circuit and the other five controlling it in such a way that no matter what, there never can be two input circuits simultaneously delivering a command. In principle the first push button that is actuated has priority; in the case of an absolutely simultaneous actuation, a crosslocking would take place which merely would prevent both commands from being applied. In FIGS. 5*a* and 5*b* the interlock is shown by a solid line 127 connecting six similar circuits, each feeding one of these six lines and receiving the signal from the five others. At the input of the circuit control (FIG. 8), a flip-flop 129 prevents any mechanical chatter from the pushbuttons. An output $FF_1$ "Q" is used for the commands, for instance the display of the time in another locale, as previously considered, which requires an extended depression of one pushbutton.

The circuit receives a clock-output of 8 Hz and discriminates against this kind of pulses for eight steps of this clock output and applies the desired command just after one second.

The FIGS. 5*a* and 5*b* also show separately, and correctly so, the three command outputs CP, DP, LP for each of the six pushbutton circuits.

Using the conventional graphics for gates and flip-flops, FIGS. 5*a* and 5*b* will be easily understood by the electronics artisan. FIG. 5*b* shows the selection of the modes RN, RTI, RTII and also the selections of the no correction, forward correction, backward correction and panel operations situations. FIGS. 5*a* and 5*b* are again arranged in summary form by display line, and it is seen that the left pushbuttons deliver pulses, $\beta_1$, $\beta_2$, $\beta_3$, which in the correction situation suppress a signal output LB1, 2, 3 that indicated this line was free of correction. In this case, an overall signal Lb, denoting release, vanishes to give place to a general signal CEC (bottom of FIG. 5) indicating "correction in progress". It will be easily understood in the light of the set of gates and flip-flops how a short pulse on the considered line terminates the correction mode and re-establishes the clear condition. A similar circuit CIBL1, 2, 3 implements the acknowledgement of the corrections on each line, only one internal arrangement of such a circuit being shown, as they are all identical. FIG. 5*a* also shows how the LB function, or its inverse CEC, acts to restrict the choice of modes and to maintain only the SCAV and SCAR correction situations in conformity with the above discussion. Lastly, the functions of the circuit of FIG. 5 consist in providing the display commands in conformity with the display cycle previously indicated. An additional command cq, $\overline{cq}$ is provided when the pushbutton controlling the change in mode is kept depressed more than one second. The purpose of this control cq shall be explained further below in relation to the computer operation, as it deals with the redetermination of the equinox time data. A set of flip-flops and of gates at the bottom right of FIG. 5*a* also functions together with certain computer circuits of which the operation shall be explained further below.

Figure 6:
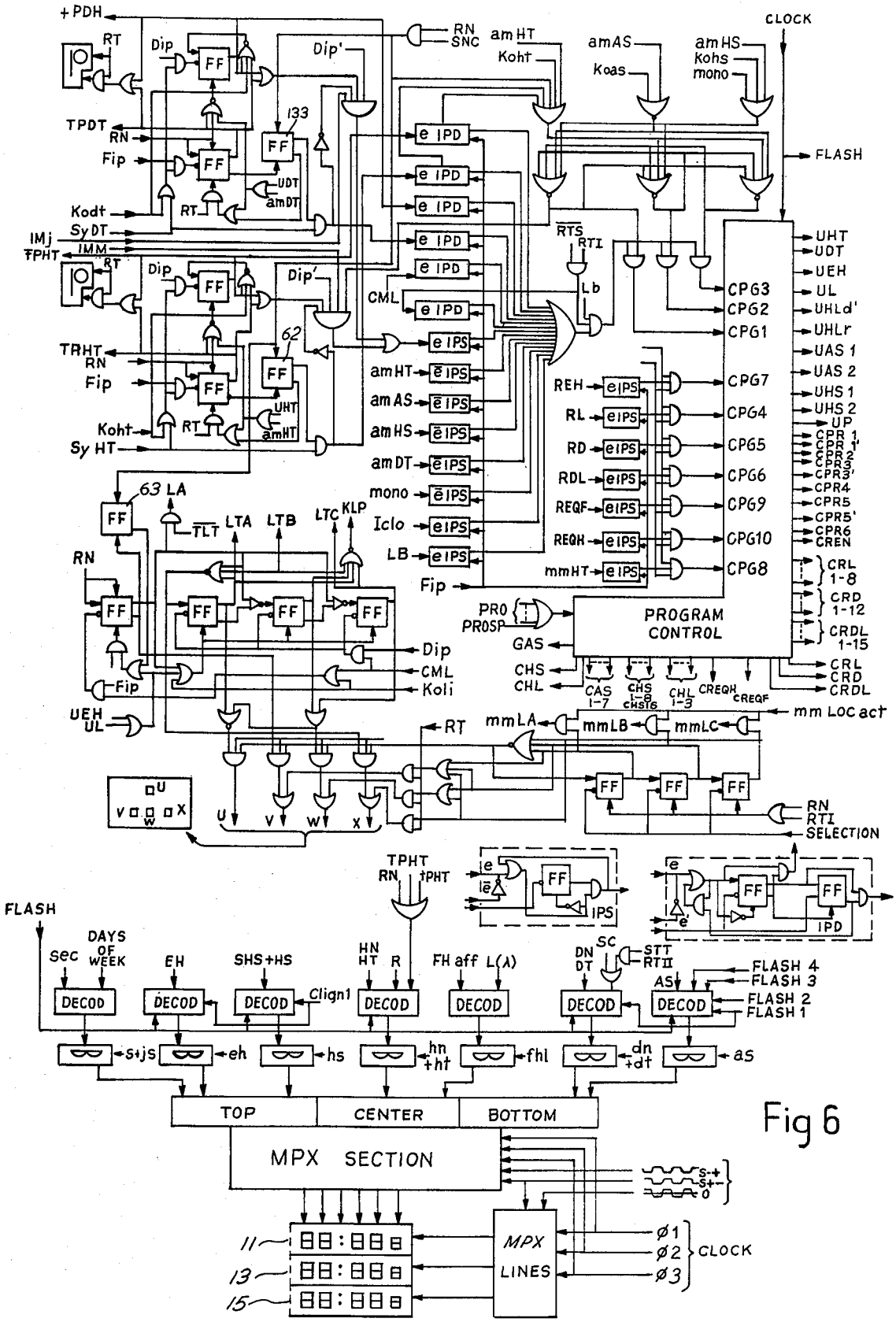
FIG. 6 is a diagram showing that part of the watch circuit which constitutes the overall internal control of the watch functions, in particular the control of the computer functions as a function of the operational commands (FIG. 5) and of the overall formulated data (FIG. 4)

Viewing FIG. 5*a*, it is easily understood in which circumstances the various commands are issued, and it will also be seen, mainly in relation to FIG. 6 and also FIG. 5*b*, what the purposes of these various commands are.

FIG. 5*b* represents the array of the nine different commands that may be issued by the three right pushbuttons. The diagram mainly covers AND gates and clearly shows how these commands are arrayed as a function of the SC correction situation or the operation STT panels situation, also depending on the RTI and RTII modes and again on the display modes which are controlled by the commands from the circuits of FIG. 5*a*. The various commands are denoted by their names on the left of FIG. 5*b* and relate either to the overall diagram of FIG. 4 or to the general command diagram of FIG. 6, certain commands being applied to the circuit components of FIG. 5*a*.

FIG. 5*b* also shows a certain number of commands joined by OR gates; the resulting signals are mainly applied to points of the control circuits of FIG. 6 to de-synchronize the operational date and time and the place. The six commands "DAWN", "SUNRISE", "NOON", "DESCENT", "DUSK" and "SUNSET" are joined in one signal "MONO" which in particular acts on the flip-flop shown at the top of FIG. 5*a* to ensure the display of the sun elevation on the first line.

It was seen that in conjunction with the external operation of the watch to implement corrections, a short pressure acts on the first main digit to the right, a long pressure acts on the first main digit on the left (just left of the two display dots), and a double pressure acts either on the decade digit (located just right of the two dots) or on the auxiliary digit which as a rule stands for tenths. For instance as regards the correction of the data "time zone, latitude", a short pressure acts on the digit of the units of degrees latitude. A double pressure acts on the command of the tenths of degrees latitude and a long pressure acts on the units of the time zone if the first one to take place since initiating the corrections, otherwise it acts on the digit of the decades of degrees if previously the units and tenths of degrees have been corrected. To that end, a PDC circuit 131 shown at the bottom of FIG. 5*b* in detail is used, which splits the correction command by a long pulse in the manner indicated above. The diagram within the BDC frame is easily understood a flip-flop of the RS type formed by two inverted OR gates, (the flipflop passing into the operational position when there is a short pulse or a double pulse and returning into the rest position during the release taking place when all the corrections have been receipted), switches the long pulse control either to the decades (second main digit from the right) or to the following digit (in the case of azimuth, the hundredths of a degree, in the case of time-zone and latitude display to the units of the time zones).

Again it is noted that the RDL command to search for date and locale can only be implemented if, considering that the watch is in the panel II mode, both storage of the sun elevation HS and of the solar azimuth AS have taken place, which is done by the set of gates appearing at the bottom right in FIG. 5*b*.

Also, the REH command to search for the time deviation can only take place if the last setting of the register of local time HL was made from the computer, or else if a storage of the local time (mmHT) was previously carried out. This is carried out by the set of gates shown at the bottom center of FIG. 5*b*.

Presently FIG. 6 will be discussed, which shows the overall control of the watch and mainly of the computer, also the display control. All the way at the top left, there is a set of three flip-flops and of different gates which assures date synchronization and desynchronization as already discussed. A similar set located just below ensures the synchronization and desynchronization of time (in the panels mode). This set issues a TPDT signal for the date and a similar TPHT signal for the time whereby at the beginning of the panels mode, the time and the date coming directly from the time counting chain are maintained in order to operate if necessary the computer (determining the sun elevation and the solar azimuth at the present instant). A similar tPDT signal for the date and tPHT signal for the time re-establishes the date and time synchronization, but in this cae by the intermediary of the operational register for the date and time. It will be noted that the maintenance of the date and time data directly from the counting chain at the beginning of the panels mode will be assured only if in preceding normal mode the no correction situation SCN was jointly present, so that three flip-flops denoted respectively 133, 135 and 137 passed into the operational state. If this was not the case, that is if for instance there was transition from the panel II mode into the panel I mode by the intermediary of the normal mode but in the correction situation, the panel I mode is directly re-established by the date, time and place data from the operational registers. It will also be noted that the first de-synchronization, reactivating the operational registers, will be immediate in the event of a memory call for the time or a memory call for the date (amHT, amDT), or if a computer operation makes the operational date and time register assume a particular position (pulses UDT or UHT), on the other hand, if the desynchronization is due to an attempted date and time correction, there will be no other effect than the de-synchronization itself, but without correction. This is necessary because the first de-synchronization modifies the display in question and, to implement a correction, the initial position must be known. To that end the signal to move the operational-register return flip-flop is applied to the flip-flop input by means of one OR gate of which the other received a Fip signal which takes place only at the end of the process. The top left of FIG. 6 also shows the arrangement of gates which in the panels mode causes the display of the symbol "p" or "o", indicating the date or the time is synchronized or de-synchronized. At the center of the FIG. 6, on the left, a cascade of four flip-flops controlled by the locale-changing pulse CML and accessorily by the Dip pulse occurring at the beginning of the process and by the Fip pulse occurring at the end of the process sets up the commands LA, CTA, CTB, LTC controlling the call for the locale data stored in the memories LOC A, LOC B, LOC C. The structure of the gates shown easily demonstrates how this flip-flop cascade works. Below, four AND gates, one inverted OR gate and one OR gate determine the excitation of the dots u, v, w, x arrayed in a triangle which indicate the locale in view of the discussion above. To the right of these gates, a three flip-flop cascade allows selecting a memory LOC to introduce in it locale data. Obviously this will be possible only in the panel II mode, the three flip-flops being mandatorily reset to zero in the normal mode RN and in the RTI panel mode. The command "mmLOC selection" allows choosing one of three flip-flops and by means of it one of the three LOC memories, and thereafter the command "mmLOC act" implements the entire locale data displayed into the selected memory. By the intermediary of OR and AND gates, these same flip-flops ensure the flashing of one dot, two dots or three dots at the time a memory reset is possible resp. in LOC A, LOC B, LOC C.

The main function of the circuit shown in FIG. 6 is to control the general and individual computer programs. A certain number of IPS circuit (single) and IPD circuits (double) of which the internal design is shown in FIG. 6 reshape signals that thereupon are connected by an OR gate and cause the realignment in the panel I mode to the extent there is no correction in progress (signal Lb) and there be no special panel mode (signal $\overline{\text{RTS}}$). As can be seen, these IPS and IPD circuits deliver a command which in the case of IPS, depending on the positive or negative case, begins with a jump of the signal applied to the circuit input and terminates at the next Fip pulse, and which in the case of the double circuits IPD begins at the next Fip pulse and terminates at the one thereafter. Due to this design, every time a realignment with respect to the panel time HT or the solar azimuth or elevation AS and HS must take place, a signal appears at one of the three inputs controlling the general program CPG1, CPG2 or CPG3 of the program control block. The selection of these three inputs is carried out by a set of three OR gates and of three inverted OR gates shown at the top of the FIG. 6 and switching the signal from the big fourteen-input OR gate to one of the three inputs previously cited of the program control as a function of the last correction or memory-call operation taking place, whether with respect to the time, the solar azimuth or elevation. This constitutes the program control in the panel I mode.

In the panel II mode, the search commands RL, RD etc. directly actuate IPS circuits which in a variation of the invention might be bypassed, and provided no correction be in progress and that indeed the mode be panel II, pulses lasting about 1/7 s (until the next pulse Fip) are applied to the inputs CPG4-10 of the program control.

Depending on these input commands, the program control sends pulses actuating the different elementary programs of the computer. The program control also emits pulses at the end of a general program ordinarily comprising a plurality of individual computer programs, a pulse U (UHT, UDT . . . UHS2) which, as seen in relation to FIG. 4, causes the write-in of the data obtained by the computer from the operational registers corresponding to the data-obtaining circuits of FIG. 4. These controls will still be discussed in detail in conjunction with the computer operation.

The bottom of FIG. 6 also shows the display which in this case is of the "segments/lines" multiplex type. This multiplexing type is known, each line comprising 37 segments including the two dots, and each of the three lines in turn may receive a drive voltage on the selected segments; in this manner the number of connections with the display is substantially reduced. The principle is known, the rear electrodes of two lines out of three are at zero voltage (see bottom right of FIG. 6), whereas the third line is at a voltage S+−. As regards the segments, either selectively the same voltage S+− is applied to them, in which case there is no drive, or the potential S−+ (see bottom right of FIG. 6) and then the corresponding segment is driven in that line from which the zero potential is absent. The S+− potential, in lieu of the zero potential, is cyclically permutated at a high rate on each of the three lines while the multiplexer circuit MPX Segm selects the data for the corresponding line (upper, center, lower). It is clear that many other multiplexing systems can be used. Then multiple gates transmit the data selected by the circuits of FIG. 5*a* (same notation as the data, but small letters, for instance s+j to command the display of data S+J) on each of the lines. In the watch being described, one decoder per data was chosen, taking into account that the data present a certain apparent disparity. It is obvious that also a single decoder might be provided, though relatively more complex, at the input of the multiplexing display command.

As was seen during the explanations concerning the overall external operation of the watch, flashing will be required in some cases. Such flashing applies to the corresponding decoder, in the manner shown in FIG. 6. It will be noted that in the normal mode, and also in the screen mode with synchronized hours, the two dots flash between the hour and minutes information. On the other hand they are constant when a non-synchronized time is involved. The command "flashing, no flashing of the dots" is provided by a signal from an OR gate at the inputs of which are the RN, TPHT and tPHT signals to the hours HNHT decoder on the center line.

As regards the date data, the year indication (0, 1, 2, 3) will be provided only in the correction solution or else in the panels operation situation in the panel II mode. This is ensured by an adequate signal applied to the date decoder The "Clign 1, 2, 3, 4" signals cause the AS data, and in some instances the date, the time deviation and the sun elevation data to flash in various manners, as was discussed in relation to FIG. 2. These signals are properly applied to the decoders. A general flashing signal CLIGN from the clock circuit is applied to all the decoders which must ensure flashing under certain circumstances.

Figure 7A:
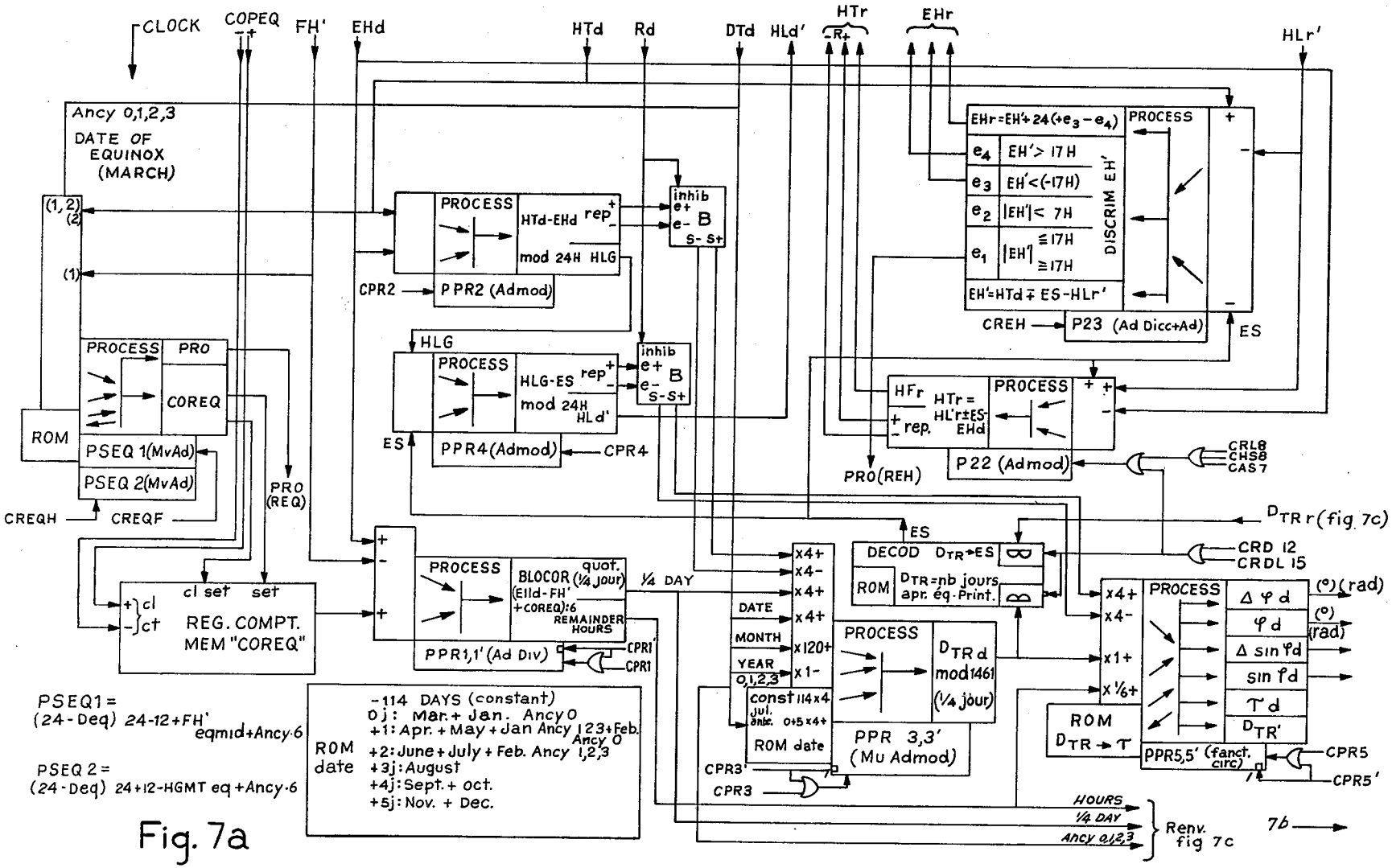
Figure 7C:
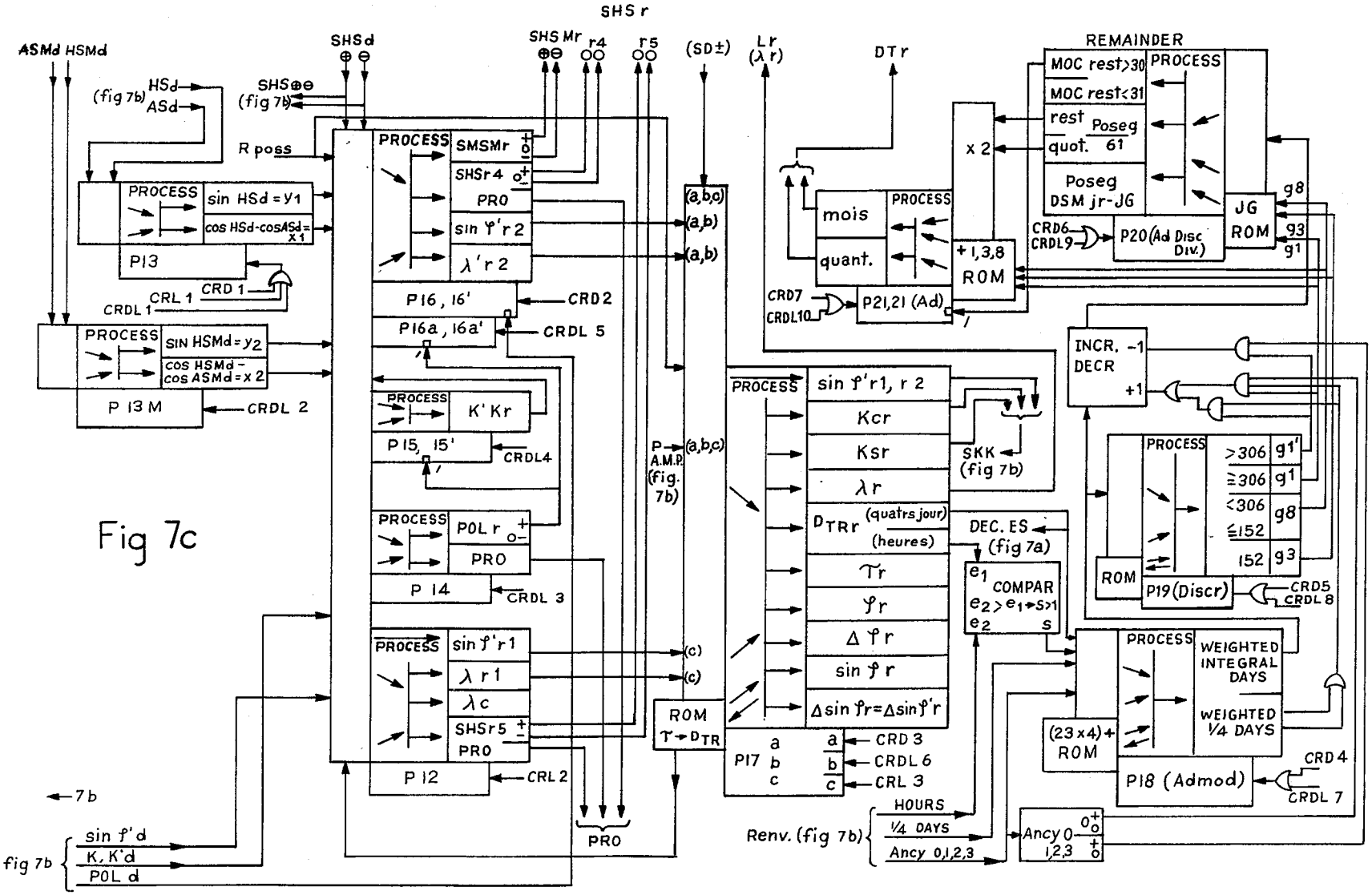

Presently and in relation to FIGS. 7*a*, 7*b* and 7*c*, the operation of the computing part will be considered. As a rule except for several OR gates and two logic circuits (LOG.A.M.P., LOG.PREP.), all of the computer operation can be explained by assuming it is a microprocessor. These being the conditions, no concrete components carrying out operations are shown, but instead program-blocks performing various operations upon the command from programs stored at various locations in the microprocessor and each time causing the operation of the same central processing unit for the most diverse mathematical and logic operations and processing the data. In an overall way, each program block comprises a vertical frame representing the data input (input interface), a frame denoted "PROCESS" and comprising the arrows symbolizing the data processing, one or more lower elongated frames symbolizing the operational program data (addition, multiplication, comparison etc) and a certain number of frames sometimes individually subdivided and at the same level as the "PROCESS" frame which symbolize the output data after treatment which shall be stored in buffer memories of possible different uses for the desired duration, that is at most a general program. A certain number of individual programs is shown in this manner. Be it noted that FIGS. 7*b* and 7*c* show several individual programs bordering on one and the same input interface in order to simplify the drawing as much as feasible. All the individual programs carry an individual notation. Except for the special case of the programs PSEQ 1 and PSEQ 2, all the general programs comprise a plurality of individual programs. Among these a certain number are preliminary programs PPR 1 through PPR 6. The selection of the preliminary necessary programs is directly implemented in the program control (FIG. 6), while on the other hand the various general programs include thereafter each their own series of controls, and as regards the subsequent elementary programs, certain controls of different general programs are combined by means of gates in a manner symbolized in the diagrams of FIG. 7.

Before considering the main computer programs, it is proper to discuss the data determination program COREQ. To be able to compute solar data, the computer must know in particular the dates, not starting on the 1st of January, but from the instant of the equinox (the Spring equinox was chosen). However, besides the fact that with respect to the instant there occurs a leapyear, the equinox falls back by 6, 12 and 18 h resp. during the following years, the equinox instant itself related to a leapyear legs approximately 2 h every 11 years. Moreover it is necessary to write-in the equinox data "REGISTRE COMPTEUR MEMOIRE COREQ" (COREQ memory counter register) in a convenient way. To that end the elementary COREQ Program has been created which for the input data requires indicating the year (0, 1, 2, 3), the day of the month on which the equinox takes place (presently on the 20th or 21st of March) and either the time zone within which the equinox occurs near noon, or the GMT time (Greenwich time) at the precise instant of the equinox (minutes may be neglected). Once these data have been entered in the watch, the PSEQ1 program must be initiated when the time zone of the noon equinox ($FH'_{eqmid}$) was introduced, or the PSEQ 2 when the GMT equinox ($HGMT_{eq}$) was. To that end a command for passing from the panel I mode into the panel II mode must be effected, keeping the upper left pushbutton BPH' depressed more than one second and then, while this button still is depressed, as the indication of the panel II appears, the pushbutton opposite BPH also must be depressed. This is purpose of the cq (and its inverse $\overline{cq}$) signal which was mentioned in relation to FIG. 5*a*. FIG. 5*b* shows that a long depression of the righthand button in question in the presence of the signal cq sets up either the REQF or the REQH command depending on the display command being that for the time or for the time zone. These commands are channeled through a circuit IPS in FIG. 6 and result in command signals CREQH and CREQF fed to the two programs selectively providing the COREQ data. Once the program has calculated the COREQ value, will in turn itself emit a pulse for the write-in of its data into the "REGISTRE COMPTEUR MEMOIRE COREQ" (COREQ memory counter register). From that time on, this memory register advances the time by one hour every five or six years, more precisely two hours every 11 years.

The COREQ data is time in hours from the time of the equinox instant of a leapyear to the first hour of 24 March in the latest time zone, and it is evident that this time always will be positive, its value increasing as the equinox instant lags. This COREQ value thereafter will be combined with the time-zone indication and then, in a later program, with the Ancy year data in order to obtain a date determined in quarters of a day from the equinox instant.

The drawing of FIGS. 7*a*, 7*b* and 7*c* clearly shows the data circulation between the different computer programs; it will be noted that the circulation of the multiple data is shown by a thick line while the information comprising only a single bit (a single conducting wire) is shown by a thin line.

As a rule, the data require first being converted before being amenable to processing; this is the purpose of the preliminary programs, most of which are shown in FIG. 7*a*. This is followed by the processing operations proper to determine for instance the sun elevation and the time as a function of the azimuth at given date and latitude for a known date. To the extent possible the various data are directly entered on the diagram of FIG. 7*c*, however the very nature of the programs carried out will be shown in a table listed shortly below.

It will be noted that it is very important to know whether the sun positions are of the morning or afternoon, namely eastern or western positions, or also meridian positions. This is settled by the AMP logic for each of the six general programs CPG1-CPG6 which require this AMP discrimination. As regards the searches, where the two data of sun height and azimuth are used as the input, the AMP logic must check that the two data in fact are on the same side. If otherwise, it will reject the data indicating the search is not possible. On the other hand, as regards the alignments, the A.M.P. data is taken from the base data (time, azimuth, elevation) and superposed on the other two parameters.

It is noted in particular that the P4 program is likely to recognize that a solar elevation, given as of the morning or of the afternoon, may correspond to the maximum and minimum elevation; in this case a pulse is transmitted to the SHS register to bring it into the meridian position. Different individual programs come into play, in particular the programs P3, P3' compute the solar elevation (by means of its sine) in the case where the base data is the non-meridian azimuth. But the base data "meridian azimuth" also may come from a sun elevation data with the symbol H (maximum) or the symbol H (minimum). In case one of these symbols is introduced, the solar elevation data need not be entered as this is taken care of by the computer.

It must also be taken into account that depending on the latitudes, the sun at given dates passes north and south and at other dates constantly stays south of north. Consequently there may be two different solar elevations for the same azimuth. The computer always first indicates which is the higher one, but the display indicates there are two elevations for the same azimuth by flashing the upper small stroke of the A of the azimuth data (FIG. 2, C31). In these conditions, the deliberate elimination of the azimuth display (to replace it by the date) and its reappearance by implementing a cycle advance by a short pressure on the lower left button causes an alignment repetition but this time introducing the lesser solar elevation corresponding to this azimuth, most of the time a negative solar elevation. In such a case, it will be the center horizontal stroke of the A indicating "azimuth" which flashes. A new and similar operation causes the higher azimuth to reappear, and so forth. This determination is made in the computer in the preparation logic as a consequence of the command pulse Clog (FIG. 5*a*). The proper parameters are fed to the preparation logic which determines the case when two azimuths are possible. It also determines the case of no azimuth existing for the indicated value, whereupon it emits the "PRO" (banned) signal. The formula for calculating the sun elevation includes a coefficient ($\delta+/-$) which may assume the value $+1$ or $-1$ and in some instances the value zero. The preparation logic calculates this coefficient. Near the equator and when approaching the equinox, the solar path may be uniquely an east-west path. In these conditions a azimuth other than 90° or 180° automatically causes the PRO signal. However a meridian azimuth, 0° or 180°, does not cause the PRO signal considering that when the sun passes its zenith, it is assumed by definition to be at the meridian. Lastly if the sun's path is "east-west" and if the zimuth is 90° or 270°, the condition is indeterminate; this is a special banned situation which is detected by the preparation logic through the PROSP signal and which results in a flashing of the whole A of the azimuth display. It must be borne in mind furthermore there are cases when the sun passes through its zenith (or through the nadir), which is the limit between a northern and a southern path and a path remaining either north or south. As regards the azimuths other than 00, 90, 180, 270, and with respect to the azimuth based alignment, the zenith value will be banned and only the other value corresponding to the azimuth will be kept, if it exists. If it does not exist (the sun then being on the wrong side), the data PRO will appear. On the other hand, regarding the azimuth values 00 and 180, the zenith value is admitted and on one hand there will be two possible elevations, (one 90° and the other between $-45°$ and $-90°$) and the two possible elevations are displayed, while on the other hand only the zenith elevation may be considered. Similarly with respect to the azimuths 90 and 270, the zenith value is indicated when the zenith path is not east-west; there are no other points on these azimuths.

Figure 10:
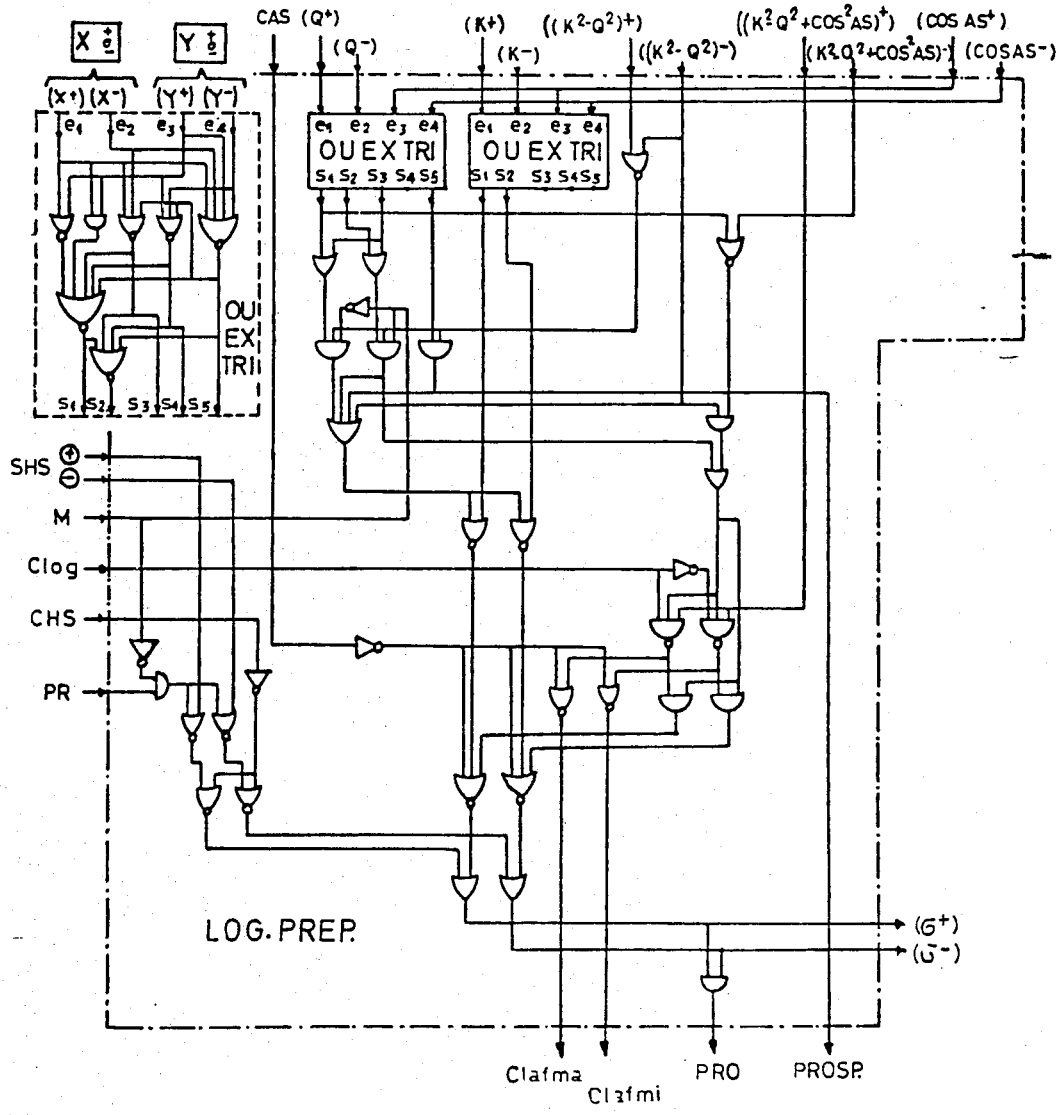
FIG. 10 shows in detail the logic diagram of a PREPARATION LOGIC block.

The preparation logic diagram is shown in FIG. 10 which clearly shows how the $\delta$ ' data is determined in the general CAS program, ie the "azimuth-based alignment command". In the CHS general program, i.e., the "sun-elevation based command", no such complex problems are raised. There might obviously be banned solar elevations (the sun never rises to 80° elevation at Bern for instance). Before discussing the individual programs in detail, it is proper to state which convention was adopted in denoting the values to be processed in some special cases.

A value denoted by one or several letters, or one or several digits, may assume all possible mathematical values. However there are values (directing bits for certain values) which can have no other value than +1, 0 and −1. These are mathematical sign values. To denote these, or to denote the part "sign magnitude" of a complete value, the parenthesises include the value notation followed by three signs ϕ just before closing the parenthesis. Thus the value (HS ⊥) denotes the value corresponding to the sun elevation and equal to +1 or 0 or −1. Certain values, for instance the cosine of the latitude, only may have two of those three values, for instance the values of (cos λ ϕ) can only be +1 and 0. There are also cases in which two of the three values are ranked alike with respect to each other and for instance (SMSN° ϕ) will have a sign value of +1 when SMSN is positive or zero and −1 when SMSN is negative. If the zero and the + had been crossed, the sign value would be zero of positive or zero values of SMSN and −1 for negative values of SMSN.

Also, there are logic values which by definition can only be 0 or +1. These are denoted by a letter with signs only at one level. For instance the value (U+) is a logic value of 1 when U is positive and 0 when U is not positive (zero or negative). Moreover the value (U−) is a logic value of +1 when U is negative and 0 when U is not negative. A three-value sign (. . . ϕ) magnitude can be denoted by two logic magnitudes, to wit (. . . +) and (. . . −). The logic values are introduced without difficulty into the mathematical equations, but they never may assume any other magnitudes than 0 and +1. If preceded by the − sign, they will be subtracted, "−(+1)" will be involved. Also a logic magnitude with a bar at the top is an inverted logic value, which will be 0 when the direct logic value is 1 and which will be 1 when the logic value is 0, there being no question of the −1 value.

Frequently there are (. . . ϕ) values in the programs, which are resolved into logic values. If the + is immediately behind the frame, a line starting from that point of the frame is considered bearing the logic value (. . . +); if the line starts from that point of the frame where the − sign is located, it is considered bearing the logic value (. . . −).

Be it furthermore noted that the data being moved toward processing are provided with the subscript d (data) whereas the data coming back from processing are provided with the subscript r (result, response), and if several data come back from processing, there will be the subscripts r1, r2 (for instance $AS_{r1}$, $AS_{r2}$ for the azimuth data coming back respectively from an alignment operation depending on the solar elevation and from an alignment operation depending on the time).

The various partial programs have been set up in such a manner as to ensure there will be no indeterminacy regarding certain values. For instance a solar azimuth computed from the time solely using sine functions becomes very imprecise when it is 6 o'clock local time, i.e., when the sun is midway between perigee and apogee. Eight pages to follow will consecutively provide the individual program indications; jointly with the schematics of FIGS. *7a, 7b, 7c,* these programs will explain the computer operation. Be it noted that for the sake of economy, certain programs include variations denoted by ', even ". The signals applied to the program frames at locations marked by a small square and a ' are not program control signals but program allocation signals modifying the program. Thus programs "'" are often set up for meridian conditions, whereas the basic program is set up for non-meridian conditions. In that case the data (M+) controls the assignment "'". In some cases there are even assignments "'", which however never come simultaneously into play with an assignment "'".

Some programs are split for instance into a program 5 and a program 5' depending on the latitude, in order to shorten the computations.

All of the computer logic is based on that view which would be provided by the observer himself when he would be seen wholly from the east or wholly from the west, with the sun rotating about the earth, for the sake of simplicity. The solar trajectory takes place in a vertical plane if observed from the equator, in a horizontal plane is observed from the pole, and in an oblique plane if observed in-between. At the equinox, this trajectory passes through the center of, and at the solstice it passes tangentially to a circle of which the radius equals the sine of the inclination of the earth axis. The effective solar trajectory does not take place in a plane that when intersected offers a straight line, but a very fine pitch helix. It is assumed to be a plane with the inclination modified at noon and midnight. In the Spring and in the northern hemisphere, the line representing the solar trajectory under the above cited conditions is made steeper by $\Delta\phi$ in the morning, from 00 h to 12 h and made shallower by $\Delta\phi$ in the afternoon from 12 h to 00 h. As the solstice nears, $\Delta\phi$ decreases, becomes null at the solstice and inverts thereafter. This is the reason the λ values (latitude) and the ϕ values (the complements to the angle formed by the earth axis and the earth-sun line become λ',ϕ' which are slightly modified in one direction in the morning and slightly modified in the other direction in the afternoon.

The pages containing the formulas below show the functions of the various individual programs, and thereafter the distribution of the controls of the individual programs in the overall programs is indicated.

It will be noted that in order to avert indeterminacy at the north and south poles, the latitudes can only be set up to a maximum of +/−89°. The latitudes registers in the LOC memories as well as in the operational locale register comprise locking means preventing counting beyond 89.0°. However the computer might issue values exceeding 89°. Still the input through the gate controlled by the UL pulse at the locale counter is designed in a manner that any count exceeding 89, that is from 89.1 to 90.0 set up the value 89 and moreover will change the state of a flip-flop which will modify the zero of 89.0 in the latitude display in such a manner it will be known the latitude is still higher. However when that value is used as the data, it will merely be 89.0

In the 89 position, while the counter prevents any correction of the absolute latitude value, it does however release any lock against a lower count for this absolute value. For this reason the locale counter receives the two data SCAR and SCAV. The other counters only receive the SCAR data because the corrections will be emitted only in the correction situation and it is enough to distinguish between SCAR and SCAV.

The overall programs may be composed in different manner regarding the individual programs they launch. In all cases the results must be those indicated.

Individual programs

PSEQ 1

COREQ = (24-Deq)×24 − 12 + FH'eqmid + (Ancy 0,1,2,3)×6
Deq = date of Spring equinox (March date)
FH'eqmid = (operational) time zone where the Spring equinox is at noon
(Ancy 0,1,2,3) = 0 for leap year; = 1 for next year, 2 for second year after leap year, 3 for third year after leap year

PSEQ2

COREQ = (24-Deq)×24 + 12 −HGMTeq + (Ancy 0,1,2,3)×6
HGMTeq = GMT time at Spring equinox
Deq, Ancy 0,1,2,3: see PSEQ 1

PPR1

BLOCOR (in quarters of a day) = (EHd−FH'd + COREQ)/6 (integral quotient)
BLOCOR (in hours) = remainder PPR1' = the same as PPR1, but EH always assumed to be 00:00

PPR2

HLG = (HTd − EHd) mode 24 hours with positive (+) and negative carries

PPR3

$D_{TRD}$ = [4×BLOCORquo + 4×date of month + 120× month − (Ancy 0,1,2,3) − 114×4 + (0 ÷ 5 per ROM)×4 + 4 (carry HLG+) − 4(carry HLG−)] . . . mod1461

PPR3' = as for PPR3, but (carry HLG+) and (carry HLG−) always assumed being 0

PPR4

Hld' = (HLG − ES)mod 24 hours with positive(+) and negative(−) carries ES provided from $D_{TRD}$ by DECODER $D_{TR}$→ES PPR 5 and PPR 5' for PPR 5: $D_{TR}'$ = [$D_{TRd}$ + 4 (carry HLd'+)−4(carry HLd'−) + (1/6)BLOCOR (hours)] mod 1461 (in ¼ day)
for PPR 5': $D_{TR}'$ = [$D_{TRd}$ + (1/6) BLOCOR (hours)] mod 1461 (in ¼ day)
the following operations are identical for PPR 5 and PPR 5' starting from $D_{TR}'$.
τd (rad) = $D_{TR}' \cdot (2\pi)/1461$ +/− correction in ROM
sinφd = (sin$\phi_{max}$ of ROM)·sin d; interim computation of sinτd (sin$\phi_{max}$ ≅ 0.4)
sinφd: $\sin\phi_{(\tau 1+\frac{1}{4}day)} - \sin\phi_{(\tau 1)} = \sin\phi_{max}\cdot\cos\phi d\cdot 2\pi/1461$
interim computation of cosτd
φd = arcsin(sinφd) natural value = φd in rad;
natural value · (360/2π) = φd in $$\Delta\phi d = \sin\phi_{max}\frac{[\cos\tau d]\cdot(2\pi)/1461}{\cos\phi d}\text{ (rad)} = \sin\phi_{max}\frac{[\cos\tau d]\cdot(360/1461)}{\cos\phi d}\text{ in}^\circ$$

interim computation of cosφd
dom sinφd = about (−0.4/0.4)
dom Δsinφd = about (−0.0017/0.0017)
dom φd = about (−23.45°/23.459) = (−0.41rad/0.41 rad)
dom Δφd = about (−0.116°/0.116°) = (−0.002/0.002 rad)

PPR 6, 6', 6"

PPR 6 applies to all parameters while PPR 6' and PPR 6" only to those respectively marked PPR 6' and PPR 6".
φ'd = φd + (1 + 2[p+]]/Δφd (in rad or °)
λ'd = (λd + 2[p+] − 1)Δφd [in °])° =

$$\left(\lambda\frac{d\cdot[360][2(p^+)}{2\pi} - 1\right)\Delta\phi d\text{ [in rad])}^\circ$$

PPR6"

POLd = ((|λ| − 45°)+) POLd = 1 for |λ| > 45°, POLd = 0 for |λ| = 45°

PPR6"

Kd = tg λ'd (for POLd = 0) K'd = ctgλ'd (for POLd = 1)
Q = sinφ'd·1/cosλ'd (for POLd = 0)
Q' = sinφd'·1/sinλ'd (for POLd = 1)
only one of these exist Kd, Kd' and only one of these Q, Q'

(cos Asma±) = [(((Q − K)$\overset{+}{\underset{-}{o}}$)+½(Q$\overset{+}{\underset{-}{o}}$)−¼)±] (for POLd = 0)

-continued

Individual programs (cos Asma±) = [(−λ)±] (for POLd = 1)

(cos Asmi±) = [(((Q+K)$\overset{+}{\underset{-}{o}}$)+½(Q$\overset{+}{\underset{-}{o}}$)+¼)±] (for POLd = 0)

(cos Asmi±) = [λ±] (for POLd = 1)

PPR6' cosφ'd = cos(φ'd)
sinφ'd = sin(φ'd)
Ksd = sinλ'd
Kcd = cosλ'd

P1 sinASd = sin(ASd) cosASd = cos(ASd); (bit(cosASd+) and bit(cosASd−))

P1a sinASr1 = sin(ASr1), cos not computed

P1b sinASd = sin(ASd) cosASd = cos(ASd) (double bit not required)

P2

$K^2 + \cos^2 As = Kd^2 + (\cos ASd)^2$
$K^2 - Q^2 + \cos^2 AS = Kd^2 - Q^2 + (\cos ASd)^2$; (bit (. . .+) and bit (. . .−))

[(K² − Q²)±o) = ((Kd² − Q²)$\overset{+}{\underset{-}{o}}$)

P2'

$1 + K'^2\cos^2 AS = 1 + K'd^2(\cos ASd)^2$
$1 - Q'^2 + K'^2\cos^2 AS = 1 - Q'^2 + K'd^2 + (\cos ASd)^2$; (bit (. . .+) and bit (. . .−))

((K − Q)$\overset{+}{\underset{-}{o}}$): no computation, always (. . .+) = 1 and (. . .−) = 0

P3

$$\sin HS = y = \frac{Q\,Kd}{K^2 + \cos^2 AS} + (\sigma\overset{+}{\underset{-}{o}})\left|\frac{\cos Asd}{K^2 + \cos^2 AS}\cdot\sqrt{Kd^2 - Q^2 + \cos^2 AS}\right|$$

(σ$\overset{+}{\underset{-}{o}}$) given b LOG.PREP

HSr1 = arc sin Y = arc sin (sinHS) dom. HS = (90° ÷ + 90°)

P3'

$$\sin HS = y = \frac{Q'}{1 + K'd^2\cos^2 AS} + (\sigma\overset{+}{\underset{-}{o}})\left|\frac{K'd\cos AS}{1 + K'd^2\cos^2 AS}\cdot\sqrt{1 - Q'^2 + K'd^2\cos^2 AS}\right|$$

HSr1 = arc sin Y = arc sin (sinHS)

(σ$\overset{+}{\underset{-}{o}}$) → (σ+), (σ−); (LOG.PREP.) (also see FIG. 10)

(σ$\overset{+}{\underset{-}{o}}$) = +1; (σ+) = 1; (σ−) = 0
(σ$\overset{+}{\underset{-}{o}}$) = 0; (σ+) = 0; (σ−) = 0
(σ$\overset{+}{\underset{-}{o}}$) = −1; (σ+) = 0; (σ−) = 1
*"forbidden"; (σ+) = 1; (σ−) = 1

* = wrong manoeuver, computation stopped (for instance: AS does not exist for date and latitude)

P4

OC=(sinφ'd+Δsinφd(1+(P+))cos(λd+(2(P+)−1)Δφ)
U' = (sinHSd − OC); (U'+), (U'°), (U'−)

(U±) = (U'+)+(U'°)$\overline{(P+)}$ −(U'°)(P+) −(U'−)

for flip flop SHS ⊕,⊖: (U+) = (U'+)+(U'°)$\overline{(P+)}$, (U−) = (U'−)+(U'°)(P+)
AC = φ−λ(U±)+Δφ[1+(U±) +2(P+)(1−(U±))]
V' = 90°−|AC|−(U±) HS; (V'+), (V'°), (V'−)

(V$\overset{+}{\underset{-}{o}}$) = (V'+)−(V'°)(P+)(U−)−(V'−)

for rectifier "MS" on SHS (AMP) (A+)=0, (M+)=1,(P+)=0:

(V°) = (V'°) $\overline{(P+)(U-)}$
(V−) = (V'°)(P+)(U−)+(V'−)

sinHSd = sin(HSd)
cosHSd = cos(HSd)

-continued

Individual programs

P4a sinHS not computed, cos HSr = cos(HSr), $(U^{\pm})$, $(V\overset{+}{\underline{o}})$ not computed P4a' sinHSr = sin (HSr), cosHSr = cos(HSr), $(U^{\pm})$, $(V\overset{+}{\underline{o}})$ not computed P4b sinHSd = sin(HSd), cosHSd = cos(HSd), $(U^{\pm})$, $(V\overset{+}{\underline{o}})$ not computed

P5

$$\cos ASr_1 = \frac{\sin(\phi'd-(\sigma^{\pm})\lambda'd)+Kd((\sigma^{\pm})\cos(\phi'd-(\sigma^{\pm})\lambda'd)-\sin HS)}{\cos HS}$$

$ASr_1 = \pm\text{arc}\cos(\cos ASr_1) \bmod 360$ $= 180+((P^+)-\overline{(P^+)})\text{arc}\cos_{nat}(-\cos ASr_1)$

P5'

$$\cos ASr_1 = \frac{K'd\sin(\phi'd-(\sigma^{\pm})\lambda'd)+(\sigma^{\pm})\cos(\phi'd-(\sigma^{\pm})\lambda'd)-\sin HS}{K'd\cos HS}$$

$ASr_1$: as for P5 starting from cos ASr1

$(\sigma\overset{+}{\underline{o}}) = (\sigma^{\pm})$ as for P5 and P5'

$(\sigma^+) = 1$ & $(\sigma^-) = 1$: forbidden

P6

$\cos ASr_1 = (\cos ASma^{\pm})(\sigma^+) + (\cos Asmi^{\pm})(\sigma^-) = +1$ or $-1$ $ASr_1 = 90°\ (1-\cos ASr_1) = 000°$ or $180°$ $(\sigma^{\pm})$: same as remark as for P5, P5'

P7

$HS = (\sigma^{\pm})(90°-|\lambda'-(\sigma^{\pm})\phi'|)$ $(\sigma^{\pm})$: same remark as for P5,P5' sinHS not computed by P7 but by P4a'

P8a,P8b,P8c

GA1 = cosHS·sinAS $$GA2 = \frac{\sin HS-(Ks\overset{+}{\underline{o}})\cos HS\cdot\cos AS-\sin'(Ks-(Ks\overset{+}{\underline{o}})Kc)}{Kc+|Ks|}$$

$(SMSM°^{\pm}) = ((|GA1|-|GA2|)°^{\pm})$ 8a,8b,8c: identical computations, data are from different inputs 8a: cos $ASr_1$, sin$ASr_1$, cosHSd, sinHSd 8b: cosASd, sinASd, cosHSr, sinHSr 8c: cosASd, sinASd, cosHSd, sinHSd P8a',P8b',P8c' inhibited programs P8a,P8b,P8c (meridian)

P9

$$HLr = 180°+((P^+)-\overline{(P^+)})\cdot 90° + \text{arc ctg}\frac{GA1}{GA2}$$

P9'

$$HLr = 180°+((P^+)-\overline{(P^+)})\cdot 90° + \text{arc tg}\frac{GA2}{GA1}$$

$(SHS^{\pm})r3 = (GA2^+)+(GA2°)\overline{(P^+)}-(GA2°)(P^+)-(GA2^-)$ for P9 and P9'

P9'',P9''sp $HLr = 90°((SHS^{\pm})+1)$ $(SHS^{\pm})r3 = (\sigma^{\pm})$ for P9'', $(\sigma^{\pm})$: same remark as for P5, P5'

$(SHS^{\pm})r3$ = "given" for P9''sp

P10E $$\left.\begin{array}{l}\sin HLd = \sin(HLd)\\ \cos HLd = \cos(HLd)\end{array}\right\} * = \text{bit}(\ldots^+) \text{ and bit}(\ldots^-)$$

HLd,HLr in (°), HLr', HLd' in (H+Min.)

P10

$\sin HSr_2 = \sin\phi'd\cdot Ksd-\cos HLd\cdot\cos\phi'd\cdot Kcd$ $HSr_2$ = arc sin(sinHSr) natural value $(-90° \div +90°)$ $$TAS = \frac{\cos HLd\cdot Ksd + \text{tg}\phi'd\cdot Kcd}{\sin HLd}$$

$(PAS^{\pm}) = ((|\cos HLd\cdot Ksd + \text{tg}\phi'd\cdot Kcd| - |\sin HLd|)°^{\pm})$

P10'

$HSr_2 = (\cos HLd^{\pm})(|\phi'd+(\cos HLd^{\pm})\lambda'd| -90°)$ meridan: $\cos HL = (\cos HL^{\pm})$ TAS et $(PAS^{\pm})$ = not computed, $(PAS^{\pm}) = +1$, $(PAS^-) = 0$

P11

$(PAS^-) = 0$ $ASr_2 = 180°+((P^+)-\overline{(P^+)})\cdot 90°-$ arc ctg 1/TAS;

-continued

Individual programs (arc ctg = natural value)

P11'

$(PAS^-) = 1$ $ASr_2 = 180°+((P^+)-\overline{(P^+)})\cdot 90° -$ arc tg TAS;

(arc tg = natural value)

P11'' meridan, $(PAS^-) = 0$ $ASr_2 = 90°\cdot\frac{1}{2}[(1-(\cos HLd^{\pm}))(1-(\cos ASma^{\pm}))+(1+(\cos HLd^{\pm}))(1-(\cos ASmi^{\pm}))]$ $ASr_2 = 000°$ or $180°$

P12

$$PRO = \overline{(Rposs^+)} + ((y_1^2+x_1^2-\sin^2\phi'd)^-) + \ldots + \overline{((|y_1|-|\sin\phi'd|)^-)\cdot[((x_1\overset{+}{\underline{o}})-(\sin\phi'd\overset{+}{\underline{o}}))°]}$$

i.e. $(PRO^+)=1$ if: not "Rposs", or $(y_1^2+x_1^2-\sin^2\phi'd)<0$, or $(|y_1|-|\sin\phi'd|)\leqq 0$ with $(x_1\overset{+}{\underline{o}}) \neq (\sin\phi'd\overset{+}{\underline{o}})$ $\lambda_c,\lambda'r,(SHSr_5\overset{+}{\underline{o}})\sin\phi'r_1$, computed only if $(PRO^+)=0$, i.e. $\overline{(PRO^+)}=1$ $$\lambda_c = \text{arc ctg}^*\frac{y_1}{x_1} -(SHSd\oplus\ominus\pm)\text{arc}\cos\frac{\sin\phi'd}{\sqrt{x_1^2+y_1^2}}* =$$

if $y_1>x_1$: . . . arc tg $\frac{x_1}{y_1}$ $\lambda'_r = \lambda_c -((n_1^{\pm})+(n_2^{\pm}))\cdot 90°$ $(n_1^{\pm}) = ((\lambda_c-90°)°^{\pm})$; $(n_2^{\pm}) = ((\lambda_c+90°)°^{\pm})$ $(SHSr_5\overset{+}{\underline{o}}) = ((y_1-|\sin\phi'd|)°^+) - ((y_1+|\sin\phi'd|)°^-)$ $(SHSr_5^+) = ((y_1-|\sin\phi'd|)°^+)$ $(SHSr_5^-) = ((y_1+|\sin\phi'd|)°^-)$ $(SHSr_5°) = ((|y_1|-|\sin\phi'd|)^-)$ $\sin\phi'r_1$ = sinφ'd unprocessed transmitted value

P13

$y_1$ = sinHSd; $x_1$ = cosHSd·cosASd

P13M $y_2$ = sinHSMd; $x_2$ = cosHSMd·cosASMd

P14

$PRO = \overline{(Rposs^+)}+((y_1-y_2)°)$ $(POLr\overset{+}{\underline{o}}) = ((|x_1-x_2|-|y_1-y_2|)°^{\pm})$; $(POLr^+) =$ 1 if $|x_1-x_2|>|y_1-y_2|$

P15

P15 is for $(POLr°^-)=1$; $(POLr^+)=0$ $$Kr = \text{tg}\lambda'r = \frac{x_2-x_1}{y_1-y_2}$$

P15'

P15' is for $(POLr^+)=1$ $$K'r = \text{ctg}\lambda'r = \frac{y_1-y_2}{x_2-x_1}$$

P16a,P16a'

$PRO = \overline{(Rposs^+)} + ((|\sin\phi'd|-\sin\phi'_{max}\text{ de ROM}^+)$ the following five computations take place only if PRO=0, i.e. if $(PRO^+)=0$ $\lambda'r_2$ = arc tg Kr for P16a $\lambda'r_2$ = arc ctg K'r for P16a' range $\lambda'r_2$: $(-90° \div +90°)$ $$\sin\phi r_2 = (x_1+y_1\cdot\text{tg}\lambda'r_2)\cdot\cos\lambda'r_2 = (x_1+y_1\cdot\text{tg}\lambda'r_2)\left|\frac{1}{\sqrt{1+\text{tg}\lambda'r_2}}\right|$$

$(SHSr_4\overset{+}{\underline{o}}) = ((y_1-\sin\phi'r_2\cdot\sin\lambda'r_2)\overset{+}{\underline{o}})$ $(SHSMr\overset{+}{\underline{o}}) = ((y_2-\sin\phi'r_2\cdot\sin\lambda'r_2)\overset{+}{\underline{o}})$

P16,P16' same as P16a,P16a', with POLd,Kd,K'd (of PPR6) in lieu of POLr,Kr,K'r

P17 a,b,c only determinant for the data sources, the operations on the homologuous data are similar when taking place the ten computations below only apply for $(Rposs^+) = 1$ $\Delta\sin\phi r$ $(=\Delta\sin\phi'r)$ =

-continued

Individual programs $$(SD^{\pm})(\sin\phi_{max} \text{ de ROM})\cdot RP\left|\sqrt{1-\frac{1}{RP^2}\cdot\sin^2\phi' r}\right|$$

(for a,b,c)
RP=1461/2π for $\phi'$ in rad
RP=1461/360 for $\phi'$ in °

$\sin\phi_r$ (only .p.a,b) = $\sin\phi' r_2-(2+(P^+)-\overline{(P^+)})\cdot\Delta\sin\phi r$
$\phi r$ (only .p.a,b) = arc sin($\sin\phi r$); also arc sin($\sin\phi' r$)− . . .

$$-(2+(P^+)-\overline{(P^+)}\Delta\phi r$$

$$\Delta\phi r \text{ (only .p.a,b)} = (SD^{\pm})\cdot RP\cdot\left|\sqrt{\frac{\sin^2\phi max-\sin^2\phi r}{1-\sin^2\phi r}}\right|$$

$$\tau_r \text{ (only .p.a,b)} = \left(270^\circ+(SD^{\pm})\cdot\text{arc cos}\frac{-\sin\phi r}{\sin\phi_{max}}\right)$$

mod360° dom 000° ÷ 359°
$D_{TRr}$ = [($\tau_r$ − ROM corr.)·RP] mod 1461
(only for a,b)
entire part. = number of quarters of a day
fract. part/6 = number of hours $\lambda_r$ (only for b,c) = $\lambda' r_1,r_2+[\overline{(P^+)}-(P^+)]\cdot\Delta\phi r$
$Ks_r = \sin\lambda'_{r1,r2}$
(for a,b,c)
$Kc_r = \cos\lambda'_{r1,r2}$
(for a,b,c)
$\sin\phi'_{r1,r2} = \sin\phi'_{r1,r2}$ transmitted, unprocessed value
(for a,b,c)
for P17a, P17b: $\sin\phi' r2$, $\lambda' r2$, $\sin\lambda' r2$, $\cos\lambda' r2$
for P17c: $\sin\phi' r1$, $\lambda' r1$, $\sin\lambda' r1$, $\cos\lambda' r1$

P18

DSM (= date with respect to 1 March) = [$D_{TRr}$, in ¼ days − BLOCOR, in ¼ days . . . (round-off, ¼ days, "remainder in hours: $BLOCOR_H - D_{TRrH}$") + . . . + (Ancy 0,1,2,3) + (23.4 de ROM] mod 1461 (in ¼ days)
$DSM_j$ (in days) = "4" and higher DSM binary weightings
$DSM_q$ (remainder in ¼ days) = "1" and "2" DSM binary weightings

P19

$DSM_j$ discrimination
$DSM_j \geqq 306$, 1 January to end February, $(gl^+) = 1$
$DSM_j > 306$, 2 January to end February, $(gl'^+) = 1$
$< 306$,
$DSM_j$ 1 August to 31 December, $(g8^+) = 1$
$> 152$,
$DSM_j \leqq 152$ 1 March to 31 July, $(g3^+) = 1$

INCR, DECR

Increment and/or decrement for remaining quarter days and the position of the year in the 4-year cycle (Ancy 1,2,3,4); the remaining quarter days are processed differently in the leap years (Ancy = 0) than in the three other years (Ancy = 1,2 or 3).
Function: according to the logic gates shown in FIG. 7c, it provides DSMjr = rectified DSMj.

P20

DSMjr discrimination
JG (="range" day) = 306 for $(gl^+)$, 153 for $(g8^+)$, 0 for $(g3^+)$
Poseg = DSMjr − $(gl^+)\cdot 306$ − $(g8^+)\cdot 153$ − $(g3^+)\cdot 0$
the Poseg/61 division provides the integral quotient + the remainder,
MOC = short month $\overline{MOC}$ = long month (31 day month)
Poseg/61 quotient =

[rank of period ($\overline{MOC}$-MOC) in the "range"] − 1
Remainder of Poseg/61 =

[rank of day in the period $\overline{MOC}$-MOC] − 1

Remainder > 30→MOC, remainder < 31→$\overline{MOC}$

Complete or incomplete ($\overline{MOC}$-MOC) periods: "January-February", "March-April", "May-June", "July" (incomplete), "August-September", "October-November" and "December" (incomplete).
Ranges: "Beginning of January to end of February", "Beginning of March to end of July", "Beginning of August to end of December".

P21 for $\overline{MOC}$ (long months)
date of the month for DTr = (remainder of Poseg/61) + 1
month for DTr = 2(quotient of Poseg/61) + $(gl^+)\cdot 1$ + $(g3^+)\cdot 3$ + $(g8^+)\cdot 8$

P21' for MOC (short months)
date of the month for DTr = (remainder of Poseg/61) − 30
month for DTr = 1 + 2(quotient of Poseg/61) + $(gl^+)\cdot 1$ + $(g3^+)\cdot 3$ + $(g8^+)\cdot 8$

P22

HTr = (HLr' +/− ES − EHd)mod 24 H, (or 2.12H);
with carries: . . . (carry$^+$) and (carry$^-$)

P23

EH' = HTd −/+ ES − HLr' (in hours and minutes)
EH' discrimination
$(e_1^+)$ = ((|EH'| − 1700 HOO)°$^-$)·((EH' − 7HOO)°$^+$);
$(e_1^+)$ = 1 PRO (probihited)
$(e_2^+)$ = ((|EH'| − 7HOO)$^-$)
$(e_3^+)$ = ((|EH' + 17HOO)$^-$) $(e_3^+)$ = 1 R⊕
$(e_4^+)$ =0 ((EH' − 17HOO)$^+$) $(e_4^+)$ = 2 R⊖
EHr = EH' 24HOO·($(e_3^+)$ − $(e_4^+)$)
A.M.P. LOGIC: see FIG. 9
PREPARATION LOGIC: see FIG. 10

Program control

General Program Control $$CPG1_{Dip,Dip'}\left[CHL_{CPR1,2,3,4}{}_{UHL}CHL1_{Mip}CPR5,6CHL2_{UHS}CHL3_{UAS}{}^{CHL}\right]_{Fip}$$

$$CPG2_{Dip,Dip'}\left[CAS_{CPR1,3',5',6}{}_{Mip}CAS1,2,3_{UHS}CAS4,5,6_{UHL}CAS7_{UHT}{}^{CAS}\right]_{Fip}$$

$$CPG3_{Dip,Dip'}\left[CHS_{CPR1,3',5'}CHSl,CHSls_{Mip}CPR6,CHS2,3_{UAS}CHS4,5,6,7_{UHL}CHS8_{UHT}{}^{CHS}\right]_{Fip}$$

$$CPG4_{Dip,Dip'}\left[CRL_{CPR1,3',5',6',}{}_{Mip}CRL1,2,3_{U\lambda}CRL4,5,6,7_{UHL}CRL8_{UHT}{}^{CRL}\right]_{Fip}$$

$$CPG5_{Dip,Dip'}\left[CRD_{CPR6''}{}_{Mip}CRD1,2,3,4,5,6,7_{UDT}CRD8,9,10,11_{UHL}CRD12_{UHT}{}^{CRD}\right]_{Fip}$$

$$CPG6_{Dip,Dip'}\left[CRDL_{Mip}CRDL1,2,3,4,5,6_{U\lambda}CRDL7,8,9,10_{UDT}CRDL11,12,13,14,{}_{UHL}CRDL15_{UHT}{}^{CRDL}\right]_{Fip}$$

-continued

| Program control | | | |
|---|---|---|---|
| CPG7 | | | |
| | Dip,Dip',CPR1',2,3 Mip | CREH UEH | Fip |
| CPG8 | | | |
| | Dip,Dip',CPR1,2,3,4 Mip | UHL | Fip |
| CPG8 | | | no U (internal) |
| | Dip,Dip',CREQF Mip | | Fip |
| CPG10 | | | no U (internal) |
| | Dip,Dip',CREQH Mip | | Fip |

The various above cited programs commands control the programs in the manner shown by FIGS. 7*a*, 7*b*, 7*c*; however the correlations are provided below.

The lasting or extended commands CHL, CAS, CHS, CRL, CRD, CRDL control the AMP logic. Moreover CAS and CHS control the preparation logic.

The CPR1 command controls the PPR1 program, the CPR1' command controls the PPR2 program, the CPR3 command controls the PPR3 program, the CPR3' command controls the PPR' program, the CPR4 command controls the PPR4 program, the CPR5 command controls the PPR5 program, the CPR5' command controls the PPR5' program, the CPR6 command controls the PPR6 program, when there is CRL it becomes CPR6' and controls the PPR6' program, and when there is CRD, it becomes CPR6" and controls the PPR6" program.

The CHL1-CHL3 commands resp. control the programs P10E, P10 and 10'; P11, P11', P11".

The CAS1-CAS7 commands resp. control the P1 program the P2 and 2' program, the p3,p3' program, the p4*a*, p4*a*' program, the p8*b*, p8*b*', the p9,p9',p9" program, the p22 program.

The CHS1 and CHS8 commands consecutively control the P4, P7, P6, P4*a*, P4*a*', P1*a*, P8*a*, P8*a*', P9, P9', P9", P22 programs.

The CRL1-CRL8 commands consecutively control the P13, P12, P17*c*, P4*b*, P1*b*, P8*c*, p8*c*', P9, p9', p9", p9"sp, P22 programs.

The CRD1-CRD12 commands consecutively control the P13, P16 and 16', P17*a*, P18, P19, P10, P21, P4*b*, P1*b*, P8*c*, P8*c*', P9, P9', P9"sp and P22 (with the decoder $D_{TR}$-ES) programs. Lastly the commands CRDL1 through CRDL15 consecutively control the programs P13; P13M, P14; P15; P16; P17*b*; P18; P19; P20; P21; P4*b*; P1*b*; P8*c*, P8*c*'; P9, P9', P9", P9"sp; and P22 with the decoder $D_{RT}$-ES.

The computer programs include ROM memories which are shown in the drawing only when particular values must be retained, for instance transfer values $D_{TR}-\tau$ or when the storage of a different number of days depending on the month is involved, as for the dates in the ROM memory (FIG. 7*a*).

The computer comprises particular elementary programs for the general search programs whereby it is possible to ascertain the date (by the intermediary of the inclination $\phi$ and latitude $\lambda$). Once these two data have been established, either the solar elevation or azimuth will allow computing the effective time for the solar plot. However these two values are used jointly at the very level where, for the solar elevation or azimuth alignments, the local time is being computed, after having calculated the azimuth as a function of the elevation or vice versa, i.e. at the level of the program P8*a*, P8*a*', P8*b*, P8*b*', P8*c*, P8*c*'.

It must be noted that these values may be negative and hence the forward corrections result in an increase in the absolute value even in the negative direction. Any correction becoming or exceeding zero causes a change in sign in lieu of a change in value. However an advantage exception is made for the latitude; indeed, all latitude counting is carried out as if the south pole were 0 and the north pole 180, and a decoder took 90° off the north side and a complement of 90 at the south side. This is a wholly practical way to proceed, the decoding however should always take place at the output of the latitude data $L_d(\lambda_d)$.

Other functional peculiarities may be noted while studying in detail the formulas and programs, for instance the program control in case of "PRO" signal. When a PRO signal is applied to the program control (FIG. 6), this control terminates the cycle but without commanding new individual programs and without emitting write-in pulses U . . . during or at the end of the overall program. It will be kept in mind that an overall program at most lasts a hundred of ms or so, and also may be restricted to less than 1 ms, even several nanoseconds.

It will be noted with respect to FIG. 4 there are two pulses ImM and Im respectively denoting the changes in minutes and days. These pulses come from circuits shown in FIG. 6 and for the proper conditions cause a realignment of the solar elevation and azimuth with the local time derived from the official time HT.

In this manner, by setting his watch in the panel I mode and leaving the hour and the date synchronized, the user will be able to follow the sun's progress minute by minute and at any instant will have hour information at his disposal. Obviously the realignment will take place every minute only if the panel hours are synchronized with the current hours and if the realignment was not commanded for a factor other than the hour. As the start of cycle pulse Dip possibly may yet modify the hour synchronization, there will be realignment only upon the pulse Dip' which follows immediately after the pulse Dip. Be it also noted that the synchronizing circuit in addition to the pulses Dip and Dip' and the pulse Fip also emits a pulse Mip which must occur only after the command CHL1 when the AMP logic already is in the proper position. This pulse also becomes effective in the set of gates and flip-flops of the bottom of FIG. 5*a* where the various flashes are set up, in particular for the case of double azimuth. The operation of this part of FIG. 5*a* is explained by the shown logic schematic.

Figure 9:
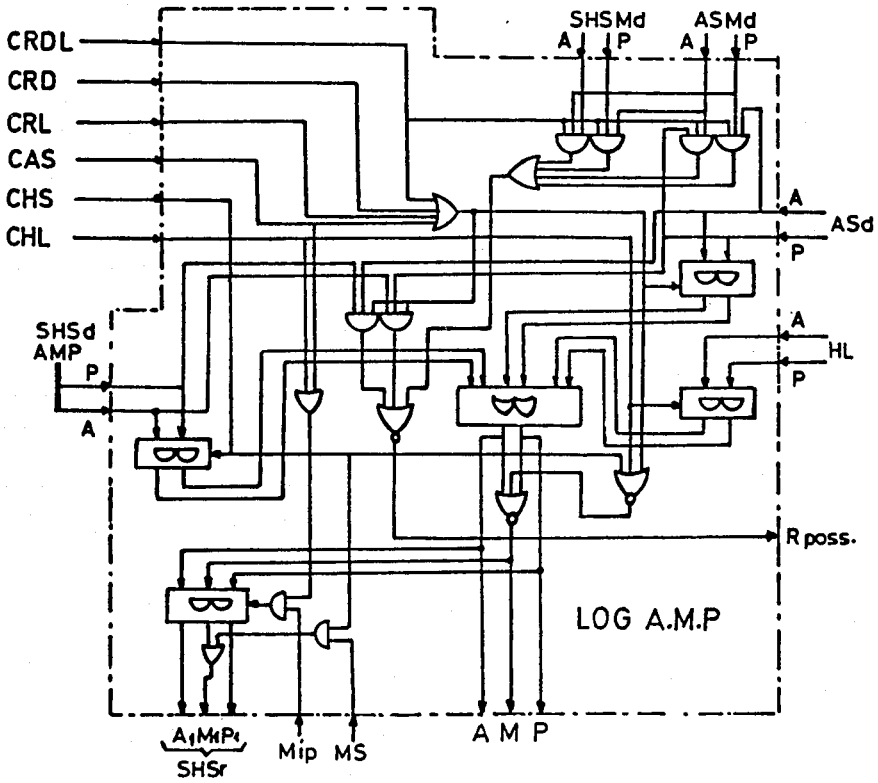
FIG. 9 shows in detail the logic diagram of an A.M.P. LOGIC block shown in FIG. 7*b*.

As regards the FIGS. 9 and 10 respectively showing the AMP and preparation logics, the same data input configuration has been adopted to the extent possible and accordingly it will be an easy matter to pass from the simple block representation of FIG. 7*b* of the more detailed representations in FIGS. 9 and 10.

As regards the commands, be it noted that that there can be only one at a time and that all commands, except those from the current time counter, can take place only at one second intervals.

WATCH FUNCTIONS SUMMARY

| | | | | | |
|---|---|---|---|---|---|
| BPH' | CP | RN | SNC, | STT | : appearance/disappearance day + seconds |
| " | | | SC | | : 1 correction acknowledged, 2 appearance/disappearance days + seconds |
| " | " | RT | SNC, | STT | : display EH-HS |
| " | " | " | SC | | : 1 correction acknowledgment 2 display EH-HS |
| " | DP | RN | | | : appearance/suppression/preparation of RT1 special |
| " | " | RT | | | : suppression of RTI special, panel regrouping |
| BPH'LP | | | | | : switching RN, RTII (from RTI to RTII); prep COREQ |
| BPM' | CP | RN | SNC, | STT | : —(always display the current time) |
| " | " | " | SC | | : correction acknowledgment |
| " | " | RT | SNC, | STT | : display FHL-HT |
| " | " | " | SC | | : 1 correction acknowledgment 2 display FHL-HT |
| " | DP | RN | | | : — |
| " | " | RT | | | : desynchronize, resynchronize HT |
| " | LP | RN | | | : extended depression, display the time of other locales |
| " | " | RT | | | : change locales, LOC A, LOC B, LOC C |
| BPB' | CP | RN | SNC, | STT | : appearance/disappearance of current date |
| " | " | " | SP | | : 1 correction acknowledgment 2 appearance/disappearance of current date |
| " | " | RT | SNC, | STT | : display date DT-AS |
| " | " | " | SC | | : 1 correction acknowledgment 2 display date DT-AS |
| " | DP | RN | | | : — |
| " | | RT | | | :desynchronize/resynchronize date DT |
| " | NP | | | | : switch SNC, SCAB, SCAR, STT |
| BPH | CP | RN | SNC, | STT | : — |
| " | " | : | SC | S + JS | : correct seconds unit |
| " | NP | | | | : switch SNC, SCAB, SCAR, STT |
| BPH | CP | RN | SNC, | STT | : — |
| " | " | : | SC | S + JS | : correct seconds unit |
| " | " | RT | SNC | | : — |
| " | " | " | SC | AFF.EH | : correct minutes unit EH |
| " | " | " | " | AFF.HS | : correct degrees unit HS |
| " | " | RTI | STT | | : single block command AUBE (dawn) |
| " | " | RTII | STT | AFF.EH | : search EH (if authorized by situation HL) |
| " | " | " | " | AFF.HS | : search for latitude date RDL (if authorize by memory) |
| BPH | DP | RN | SC, | STT | : — |
| " | " | " | SC | S + JS | : tens of seconds correction |
| " | " | RT | SNC | | : — |
| " | " | " | SC | AFF.EH | : correct tens of minutes EH |
| " | " | " | " | AFF.HS | : correct tenth of degrees HS |
| " | " | " | STT | AFF.EH | : — |
| " | " | " | " | AFF.HS | : memory call HS |
| " | LP | RN | SNC, | STT | : — |
| " | " | " | SC | S + JS | : correct day of week |
| " | " | RT | SNC | | : — |
| " | " | " | SC | AFF.EH | : time correction EH |
| " | " | " | " | AFF.HS | : correction of tens of degrees HS or sign HS |
| " | " | RTI | STT | | : sunrise |
| " | " | RTII | STT | AFF.EH | : if AFF. FHL, choice LOC ms |
| " | " | " | " | AFF.HS | : HS storage |
| " | " | " | " | | : if bbh' LP kept, COREQ |
| BPM | CP | RT | SNC, | STT | : — |
| " | " | " | SC | | : correct minutes unit, current time |
| " | " | RT | SNC | | : — |
| " | " | " | SC | AFF.FHL | : correct latitude unit |
| " | " | " | " | AFF.HT | : correct minutes unit, panel time (HT) |
| " | " | RTI | STT | | : descent |
| " | " | RTII | STT | | : if AFF.HS, search latitude RL |
| " | DP | RN | SNC, | STT | : — |
| " | " | " | SC | | : correct tens of minutes, current time |
| " | " | RT | SNC | | : — |
| " | " | " | SC | AFF.FHL | : correct tenth of degree latitude |
| " | " | " | " | AFF.HT | : correct tens of minutes HT |
| " | " | " | STT | AFF.FHL | :— |
| " | " | " | " | AFF.HT | : memory call panel time |
| " | LP | RN | SNC, | STT | : — |
| " | " | " | SC | | : correct hours unit, current time |
| " | " | RT | SNC | | : — |
| BPM | LP | RT | SC | AFF,FHL | : correct latitude tens or FH unit |

-continued

| WATCH FUNCTIONS SUMMARY | | | | | |
|---|---|---|---|---|---|
| " | " | " | " | | : correct hours unit HT |
| " | " | RTI | STT | | : noon |
| " | " | RTII | STT | AFF.FHL | : if AFF.EH,$^{mm}$ LOC Act. |
| " | " | " | " | AFF.HT | : panel time storage |
| BPB | CP | RN | SNC, | STT | : — |
| " | " | " | SC | AFF.DN | : correct date of the month unit DN |
| " | " | RT | SC | AFF.DT | : correct date of the month unit DT |
| " | " | " | " | AFF.AS | : correct degree unit AS |
| " | " | RTI | STT | | : dusk |
| " | " | RTII | STT | | : if AFF.HS, search RD date |
| " | DP | RN | SNC, | STT | : — |
| " | " | " | SC | AFF.DN | : correct current date, Ancy DN |
| " | " | RP | SNC | | : — |
| " | " | " | SC | AFF.DT | : correct Ancy panel date DT |
| " | " | " | " | AFF.AS | : correct tenth of degree AS |
| " | " | " | STT | AFF.DT | : memory call, panel date |
| " | " | " | " | AFFAS | : memory call, solar azimuth |
| " | LP | RN | SNC, | STT | : — |
| " | " | " | SC | AFF.DN | : correct month of current date DN |
| " | " | RT | SCN | | : — |
| " | " | " | SC | AFF.DT | : correct month panel date DT |
| " | " | " | " | AFF.AS | : correct tens or hundreds AS |
| " | " | RTI | STT | | : sunset |
| " | " | RTII | STT | AFF.DT | : panel date storage |
| " | " | " | " | AFF.AS | : storing AS |

A Swiss patent application relating to a similar but not identical object, namely application CH No. 1636/77 already was filed by the same initial applicant. This application, as yet not published when the present one was filed, contains drawings and explanations relating to the circuits of the watch of which at least some may be used in the object of the present invention. The contents of this patent application CH No. 1636/77 should be considered jointly with the present regarding adequacy of disclosure for implementation by the artisan.

I claim:

1. A timepiece comprising:

clock means for keeping standard time and generating first data representative thereof;

input means for inputting second data representative of a longitudinal position and a latitudinal position on the earth, and for inputting third data representative of a standard time different from said standard time represented by said first data;

calculator means responsive to said clock means and said input means for generating fourth data representative of the position of the sun at the location represented by said second data and at the time represented by at least said third data; and display means responsive to said calculator means for visually displaying indicia representative of said position of the sun.

2. A timepiece according to claim 1 wherein said standard time represented by said third data is hour and minute time of the day, month and year represented by said first data; and wherein said calculator means generates fourth data representative of the position of the sun at the location represented by said second data and at the hour and at the minute represented by said third data and at the day, month and year represented by said first data.

3. A timepiece comprising:

clock means for keeping standard time and generating first data representative thereof;

input means for inputting second data representative of a longitudinal position and a latitudinal position on the earth, and for inputting third data representative of a standard time different from said standard time represented by said first data;

a time counter register for receiving either said first data or said third data;

calculator means responsive to said input means and data in said time counter register for generating fourth data representative of the position of the sun at the location represented by said second data and at the time represented by either said first or said third data; and display means responsive to said calculator means for visually displaying indicia representative of said position of the sun.

4. A timepiece according to claim 3 wherein said time counter register is responsive to said clock means for changing said data in said time counter register with respect to time.

5. A timepiece according to claim 1 wherein said standard time represented by said third data is hour and minute time; and wherein said input means is for inputting fifth data representative of a day, month, and year; and wherein said calculator means generates fourth data representative of the position of the sun and the location represented by said second data and at the hour and at the minute represented by said third data and at the day, month, and year represented by said fifth data.

6. A timepiece according to claim 5 and further including date counter register for receiving either said first data or said fifth data; and wherein said calculator means is responsive to data in said date counter register for generating said fourth data.

7. A timepiece according to claim 6 and wherein said date counter register is responsive to said clock means for changing said data in said date counter register with respect to time.

8. A timepiece according to claim 1 and wherein said display means includes two display modes, one of said modes being a normal mode for visually displaying standard time as represented by said first data, and a panel mode for displaying longitudinal and latitudinal position on the earth as represented by said second data and a standard time as represented by said third data and the sun's position as represented by said fourth data.

9. A timepiece according to claim 8 wherein said input means further includes manually actuable means for placing the timepiece in a selected one of said modes.

10. A timepiece according to claim 9 wherein said input means includes manually actuable means for inputting said scond data and said third data, said last named input means solely operable when said timepiece is in said panels mode.

11. A timepiece according to claim 1 wherein said input means includes means for inputting sixth data representative of a position of the sun; and wherein said calculator means as responsive to said sixth data and said second data for adjusting said third data; and wherein said display means is responsive to said calculator means for visually displaying indicia representative of a standard time represented by said third data.

12. A timepiece according to claim 8 wherein said display means is operable in said panel mode to display three separate lines with each line having different ones of information.

13. A timepiece according to claim 12 wherein said input means is operable solely to input information of the type being displayed in either of said three lines.

14. A timepiece according to claim 1 and further including auxiliary memory means for storing various second data representative of different longitudinal position and latitudinal position on the earth; and further including locale register for receiving either of said second data stored in said auxiliary memory or said second data generated by said input means; and wherein said calculator means is responsive to data in said locale register for generating said fourth data.

15. A timepiece according to claim 1 and further including auxiliary memory means for storing different ones of said fourth data; and further including a sun elevation register for receiving fourth data from said auxiliary memory means or fourth data generated by said input means; and wherein said calculator means is responsive to data in said sun elevation register.

16. A timepiece according to claim 1 wherein said display means includes display segments distributed in lines and wherein said input means includes lateral controls arranged opposite said lines for visually correlating a control with selection of data represented by a corresponding said line.

17. A timepiece according to claim 1 wherein said input means includes command means, said command means comprising a plurality of pushbuttons, said command means responsive to different pushbutton manipulations for generating control signals.

18. A timepiece according to claim 17 wherein said timepiece includes means for placing the timepiece in one of a plurality of modes, one of said pushbuttons controlling a mode selection for selectively placing the timepiece in either a normal time-keeping mode or in a panel mode, said display means operable in said panel mode for displaying predetermined indicia representative of said second data, said third data and said fourth data; said input means being capable of changing either of said second data, said third data or said fourth data when in said panels mode; and wherein said calculator means being responsive to a change in one of said second, third, fourth datas for adjusting at least one of the non-changed data.

19. A timepiece according to claim 18 wherein said timepiece is capable of setting up two different panel modes: a first mode and a second mode, a timepiece in said first mode displaying position of the sun in terms of solar elevation and solar azimuth and time, and wherein said calculator means being responsive to a change in any one of said variables for changing at least one of the other variables, said timepiece when in said second panel mode for displaying a variable solar elevation, solar azimuth and geograhic location, and wherein said calculator means being responsive to a change in solar elevation or azimuth for changing said geographic location.

20. A timepiece according to claim 17 wherein one of the said pushbuttons controls a command for a non-correction situation wherein no correction at all is possible, for a forward correction wherein displayed forward data corrections are possible, for a backward correction situation wherein backward displayed data corrections are possible, for a panel operational situation wherein in the panels mode data and place searches are possible in relation to the values introduced into the watch corresponding to one or more solar elevation or azimuth data.

21. A timepiece according to claim 1 and further including memory means for prestorage of eight data representative of geograhical places by time zone; and wherein said input means is for addressing one of said eighth data; and wherein said calculator means automatically adjusts time information in relation to the selected time zone.

22. A timepiece according to claim 1 wherein said particular solar elevations include at least the elevation "00.0°, rising sun" of sunrise, only one specific elevation being the maximum when the sun passes the meridian, and the elevation "00.0°, sun descending" of sunset.

23. A timepiece according to claim 1 wherein said particular solar elevations also include an elevation "−18.0° to −12.0°, rising sun", of dawn, the elevation "+26.4°, descending sun" of the setting sun at an angle of which the arctangent is $\frac{1}{2}$, and an elevation "−12.0° to −19.0°, descending sun" of dusk.

* * * * *